US009279608B2

(12) United States Patent
Wakamoto et al.

(10) Patent No.: US 9,279,608 B2
(45) Date of Patent: Mar. 8, 2016

(54) HEAT PUMP

(75) Inventors: Shinichi Wakamoto, Chiyoda-ku (JP); Naofumi Takenaka, Chiyoda-ku (JP); Osamu Morimoto, Chiyoda-ku (JP); Hirofumi Koge, Chiyoda-ku (JP); Kazuyoshi Shinozaki, Chiyoda-ku (JP); Tomokazu Kawagoe, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 406 days.

(21) Appl. No.: 13/808,062

(22) PCT Filed: Jan. 18, 2011

(86) PCT No.: PCT/JP2011/000219

§ 371 (c)(1),
(2), (4) Date: Jan. 2, 2013

(87) PCT Pub. No.: WO2012/014345

PCT Pub. Date: Feb. 2, 2012

(65) Prior Publication Data

US 2013/0098092 A1 Apr. 25, 2013

(30) Foreign Application Priority Data

Jul. 29, 2010 (JP) ..... 2010-171071

(51) Int. Cl.
*F25B 47/02* (2006.01)
*F25B 1/10* (2006.01)
(Continued)

(52) U.S. Cl.
CPC ..... *F25B 47/025* (2013.01); *F25B 1/10* (2013.01); *F25B 5/02* (2013.01); *F25B 13/00* (2013.01);
(Continued)

(58) Field of Classification Search
CPC ..... F25B 47/025; F25B 2313/006; F25B 2313/007; F25B 2313/0231; F25B 2313/02732; F25B 25/005; F25B 30/02; F25B 47/022; F25B 2400/0403; F25B 2400/0411
See application file for complete search history.

(56) References Cited

U.S. PATENT DOCUMENTS 5,107,684 A * 4/1992 Nakayama ..... F24F 3/065 62/160
5,263,333 A * 11/1993 Kubo ..... F24F 3/065 62/160

(Continued)

FOREIGN PATENT DOCUMENTS

JP 57 108558 7/1982
JP 61 235644 10/1986

(Continued)

OTHER PUBLICATIONS

U.S. Appl. No. 14/441,945, filed May 11, 2015, Takenaka, et al.

(Continued)

*Primary Examiner* — Emmanuel Duke
(74) *Attorney, Agent, or Firm* — Oblon, McClelland, Maier & Neustadt, L.L.P.

(57) ABSTRACT

A first bypass pipe has one end connected to a main pipe extending from a compressor to an indoor heat exchanger, and its other end branched off into parts that are each connected to the main pipe on an inlet side of an outdoor heat exchanger, and a second bypass pipe has one end connected to an injection port communicating with the compression chamber of the compressor in which compression is taking place and its other end branched off into parts that are each connected to the main pipe on an outlet side of the outdoor heat exchangers. During a defrosting operation that removes frost on the outdoor heat exchangers, a part of the refrigerant discharged from the compressor is supplied from the first bypass pipe to the outdoor heat exchanger to be defrosted, and is then passed through the second bypass pipe and injected from the injection port of the compressor.

11 Claims, 13 Drawing Sheets

(51) Int. Cl.

| | |
|---|---|
| ***F25B 5/02*** | (2006.01) |
| ***F25B 13/00*** | (2006.01) |
| ***F25B 41/04*** | (2006.01) |
| ***F25B 30/02*** | (2006.01) |

(52) U.S. Cl.

CPC ..... *F25B 30/02* (2013.01); *F25B 41/04* (2013.01); *F25B 47/022* (2013.01); *F25B 2400/0403* (2013.01); *F25B 2400/0411* (2013.01); *F25B 2400/13* (2013.01)

(56) References Cited

U.S. PATENT DOCUMENTS

| | | | | |
|---|---|---|---|---|
| 5,878,589 | A * | 3/1999 | Tanaka | B60H 1/00007 165/80.2 |
| 6,418,741 | B1 * | 7/2002 | Nungesser | F16K 15/06 62/225 |
| 6,460,357 | B1 * | 10/2002 | Doi et al. | 62/199 |
| 6,467,291 | B1 * | 10/2002 | Takano | B60H 1/00914 62/196.4 |
| 2002/0035843 | A1 * | 3/2002 | Kampf | B60H 1/00328 62/231 |
| 2005/0198996 | A1 * | 9/2005 | Itsuki et al. | 62/512 |
| 2009/0095005 | A1 * | 4/2009 | Dietrich | B60H 1/00907 62/244 |
| 2012/0216989 | A1 | 8/2012 | Wakamoto et al. | |

FOREIGN PATENT DOCUMENTS

| | | |
|---|---|---|
| JP | 4 110576 | 4/1992 |
| JP | 2000 105016 | 4/2000 |
| JP | 2004 183913 | 7/2004 |
| JP | 2008 138921 | 6/2008 |
| JP | 2008 249236 | 10/2008 |
| JP | 2009 85484 | 4/2009 |
| JP | 2009-127939 | 6/2009 |
| JP | 2009 281607 | 12/2009 |

OTHER PUBLICATIONS

International Search Report Issued Feb. 15, 2011 in PCT/JP11/000219 Filed Jan. 18, 2011.

Japanese Office Action issued Dec. 24, 2013, in Japan Patent Application No. 2012-526271 (with English translation).

* cited by examiner

HEAT PUMP

TECHNICAL FIELD

The present invention relates to a heat pump.

BACKGROUND ART

In heat pumps according to the related art, to remove frost n on an outdoor heat exchanger that serves as an evaporator during a heating operation, a defrosting operation is performed by reversing the refrigeration cycle. However, this defrosting method compromises indoor comfort because heating is stopped during the defrosting operation. Accordingly, as a technology that enables a simultaneous heating operation and defrosting operation, there is a heat pump in which an outdoor heat exchanger is divided into a plurality of parallel heat exchangers with reference to a refrigerant flow diversion path, and a bypass that bypasses a discharge gas from a compressor, and a solenoid opening and closing valve that controls the bypass state are provided in each of those parallel heat exchangers (see, for example, Patent Literature 1). In this heat pump, a part of the refrigerant from the compressor is caused to enter each bypass alternately, and each parallel heat exchanger is defrosted alternately, thereby allowing heating to be performed continuously without reversing the refrigeration cycle.

CITATION LIST

Patent Literature

Patent Literature 1: Japanese Unexamined Patent Application Publication No. 2009-85484 (Abstract)

SUMMARY OF INVENTION

Technical Problem

However, in the technology according to Patent Literature 1, during the simultaneous operation of heating operation and defrosting operation, a refrigerant in a two-phase gas-liquid state that has discharged from a parallel heat exchanger that is defrosted, and a gas refrigerant that has discharged from a parallel heat exchanger that is performing heating are mixed together and sucked into the compressor. Therefore, the compressor needs to raise the pressure of not only the refrigerant used for heating but also the refrigerant used for defrosting from low pressure to high pressure, leading to a decrease in the efficiency of the heat pump.

The present invention has been made in order to solve the problem of the related art mentioned above, and its object is to provide a heat pump that can improve energy efficiency in a simultaneous operation of heating operation and defrosting operation.

Solution to Problem

A heat pump according to the present invention includes a main circuit in which a compressor, a condenser, a first flow rate control means, and an evaporator are sequentially connected by a main pipe, and a refrigerant circulates. The evaporator is divided into a plurality of parallel heat exchangers. The parallel heat exchangers are arranged in parallel at respective parts of a parallel circuit formed by branching off the main pipe at an arranged position of the evaporator. The heat pump further includes a first bypass pipe whose one end is connected to the main pipe connecting the compressor to the condenser, and whose another end is branched off into parts that are connected to the main pipe on respective inlet sides of the parallel heat exchangers and a second bypass pipe whose one end is connected to an injection port communicating with a compression chamber of the compressor in which compression is taking place, and whose another end is branched off into parts that are connected to the main pipe on respective outlet sides of the parallel heat exchangers. During a defrosting operation that removes frost on the parallel heat exchangers, a part of the refrigerant discharged from the compressor is supplied through the first bypass pipe to a parallel heat exchanger that is defrosted, and is then passed through the second bypass pipe and injected from the injection port of the compressor.

Advantageous Effects of Invention

According to the present invention, there is no need to lower the pressure of the refrigerant used for defrosting to the suction temperature. Therefore, in the compressor, only the refrigerant used for heating that circulates in the main circuit needs to be raised from low pressure to high pressure, and as for the injected intermediate-pressure refrigerant in the two-phase gas-liquid state, its pressure only needs to be raised from intermediate pressure to high pressure, thereby advantageously reducing the load to be done by the compressor and improving the efficiency of the heat pump. Also, the refrigerant in the two-phase gas-liquid state flowing from the injection port is heated by the intermediate-pressure gas refrigerant that is undergoing compression, and changes into a gas state in the compressor. Thus, the reliability of the heat pump improves.

DESCRIPTION OF EMBODIMENTS

Embodiment 1 of the Invention

Figure 1:
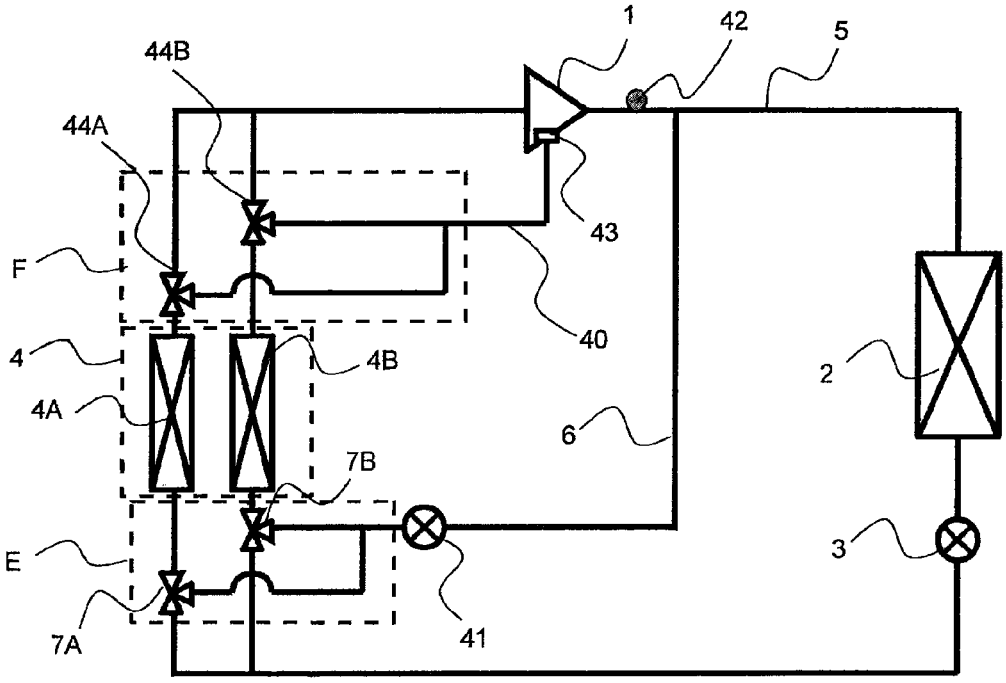
FIG. 1 illustrates the refrigerant circuit of a heat pump according to Embodiment 1 of the present invention.

Hereinafter, Embodiment 1 of the present invention will be described with reference to the drawings. In the drawings, identical or equivalent portions are denoted by identical reference signs. FIG. 1 illustrates the refrigerant circuit of a heat pump according to Embodiment 1 of the present invention.

The refrigerant circuit of the heat pump has a main circuit in which a compressor 1, an indoor heat exchanger 2, a first flow rate control means (electronic expansion valve in this example) 3 that can open and close, and an outdoor heat exchanger 4 are sequentially connected by a main pipe 5. The outdoor heat exchanger 4 is divided into a plurality of parallel heat exchangers, which in this example are two parallel heat exchangers 4A and 4B. The main circuit where the outdoor heat exchanger 4 is arranged branches off into a plurality of (two in this example) portions of a parallel circuit in accordance with the number of parallel heat exchangers. Also, the main circuit includes a first flow switching means E having three-way valves 7A, 7B, which switch the flow of refrigerant entering the parallel heat exchangers 4A, 4B (hereinafter, referred to as outdoor heat exchangers 4A, 4B) to the main circuit or a first bypass pipe 6 described later. Also, the main circuit includes a second flow switching means F having three-way valves 44A, 44B which switch the flow of refrigerant discharging from the outdoor heat exchangers 4A, 4B to the main circuit or a second bypass pipe 40 described later.

One end of the first bypass pipe 6 is connected to the main pipe 5 connecting the compressor 1 to the indoor heat exchanger 2, and the other end thereof branches off into two parts that are connected to the main pipe 5 on respective inlet sides of the outdoor heat exchangers 4A, 4B. Also, the first bypass pipe 6 is connected with a second flow rate control means 41 controlling the flow rate of refrigerant. One end of the second bypass pipe 40 is connected to an injection port 43 that communicates with the compression chamber of the compressor 1, and the other end thereof branches off into two parts that are connected to the main pipe 5 on respective outlet sides of the outdoor heat exchangers 4A, 4B. The injection port 43 is a port for injecting an intermediate-pressure refrigerant toward the refrigerant that is undergoing compression within the compressor 1. Incidentally, the main circuit refers to a portion of the entire refrigerant circuit illustrated in FIG. 1 excluding the first bypass pipe 6 and the second bypass pipe 40.

A temperature sensor 42 that measures the discharge temperature of the compressor 1 is provided at the outlet of the compressor 1 of the main circuit, outputting a detection signal from the temperature sensor 42 to control means (not illustrated). The control means (not illustrated) is further connected with the first flow rate control means 3, the first flow switching means E, and the second flow switching means F. The control means controls the first flow rate control means 3, the first flow switching means E, and the second flow switching means F in accordance with each operation mode described later or the detection signal from the temperature sensor 42. The control means (not illustrated) controls valves and flow rate control valves within the refrigerant circuit similarly also in embodiments described later.

Figure 2:
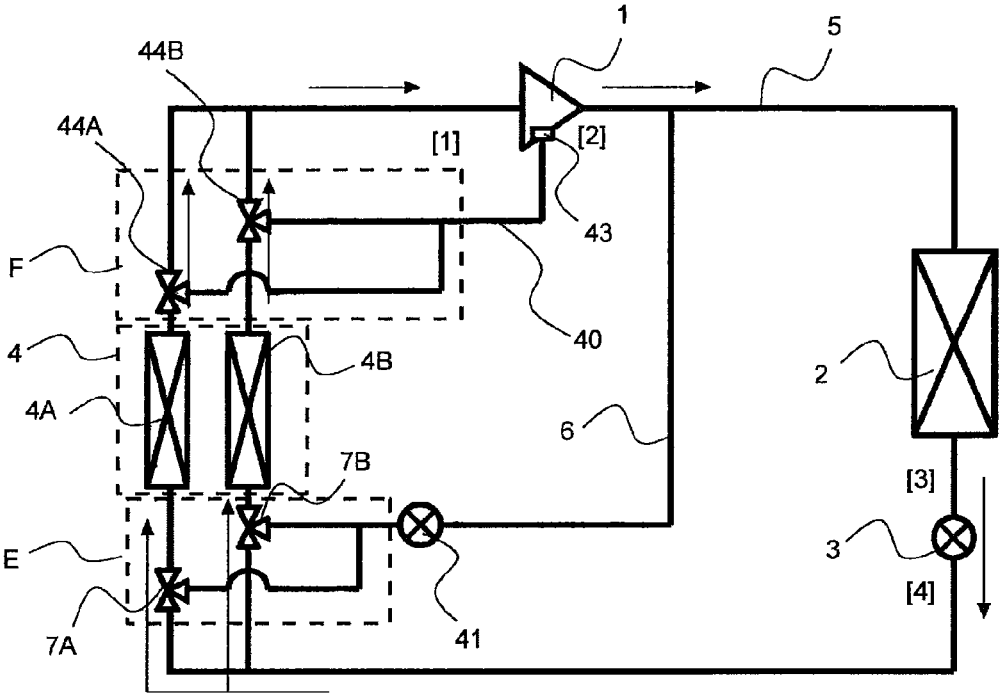
FIG. 2 illustrates the flow of refrigerant during heating only operation of the heat pump according to Embodiment 1 of the present invention.
Figure 3:
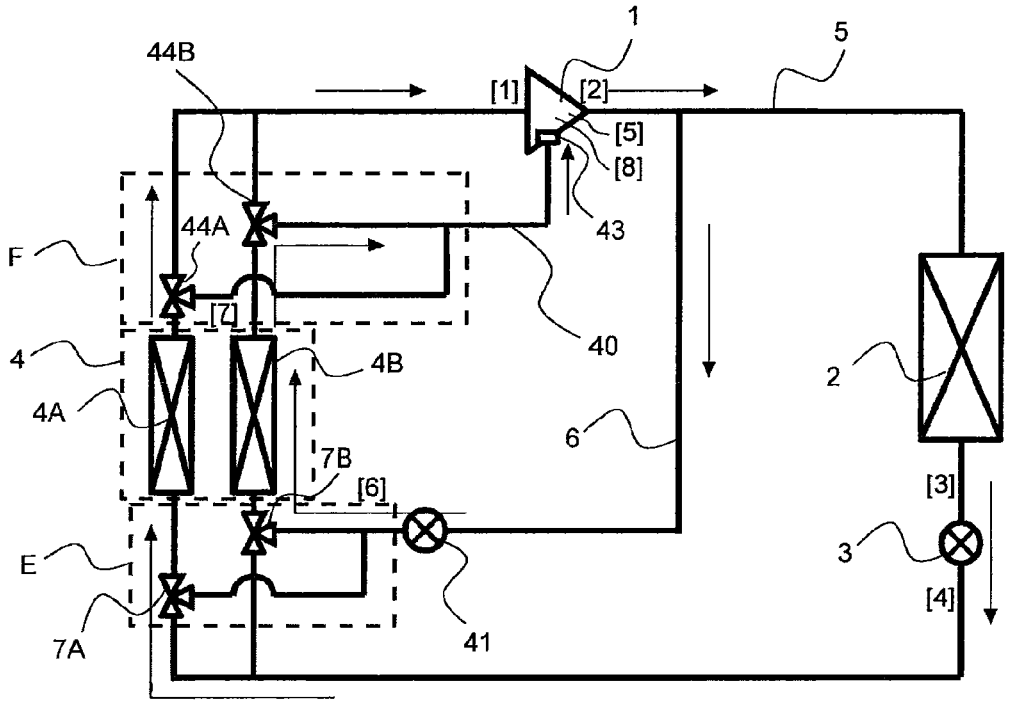
FIG. 3 illustrates the flow of refrigerant during first simultaneous heating and defrosting operation of the heat pump according to Embodiment 1 of the present invention.
Figure 4:
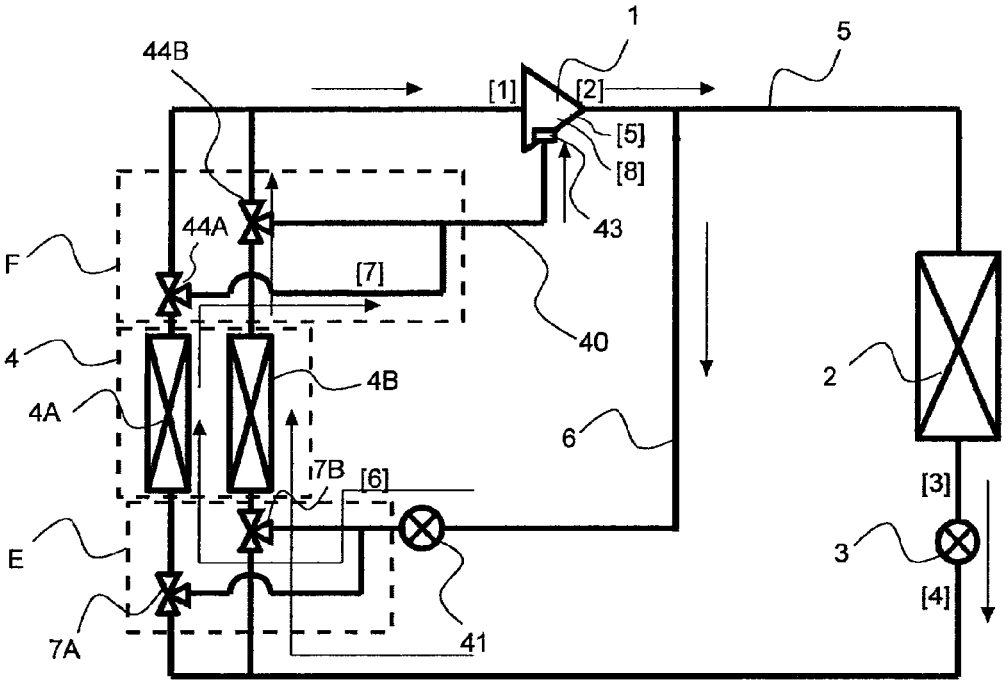
FIG. 4 illustrates the flow of refrigerant during second simultaneous heating and defrosting operation of the heat pump according to Embodiment 1 of the present invention.
Figure 5:
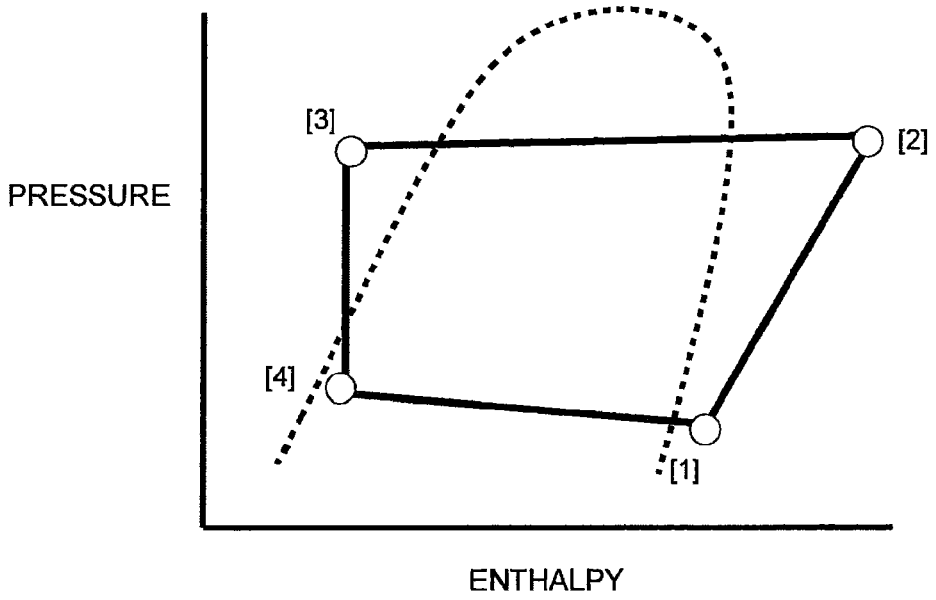
FIG. 5 illustrates the relationship between the pressure and enthalpy of refrigerant during heating only operation of the heat pump according to Embodiment 1 of the present invention.
Figure 6:
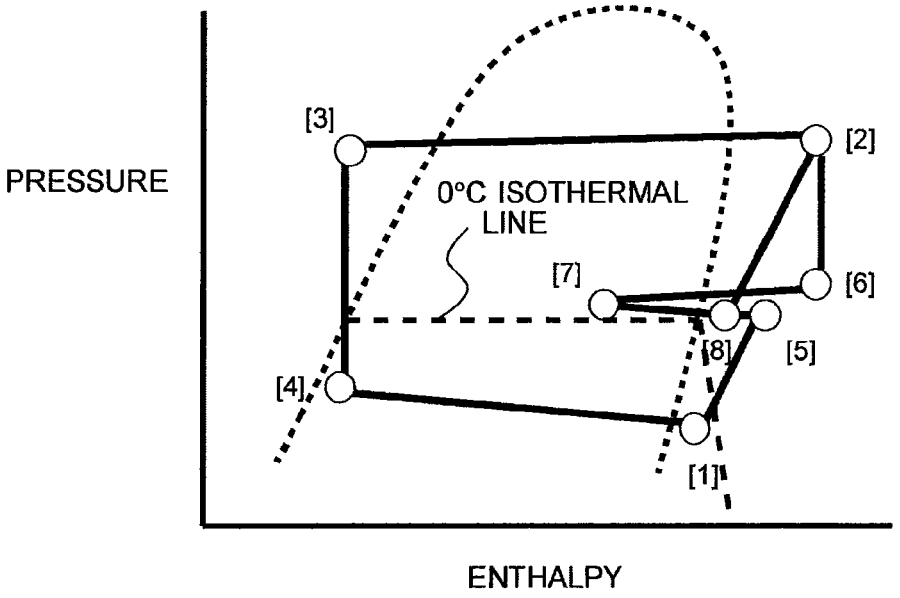
FIG. 6 illustrates the relationship between the pressure and enthalpy of refrigerant during first simultaneous heating and defrosting operation of the heat pump according to Embodiment 1 of the present invention.
Figure 7:
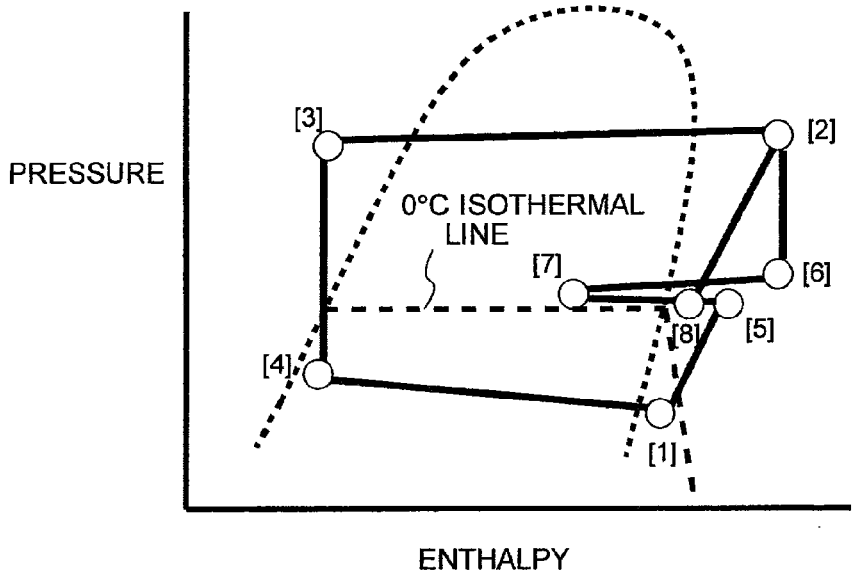
FIG. 7 illustrates the relationship between the pressure and enthalpy of refrigerant during second simultaneous heating and defrosting operation of the heat pump according to Embodiment 1 of the present invention.

Next, a description will be given with reference to FIGS. 2 to 4 that illustrate the flow of refrigerant in this device, and FIGS. 5 to 7 that are p-h diagrams (diagrams illustrating the relationship between the pressure and enthalpy of refrigerant). In FIGS. 2 to 4, solid lines indicate the flow of refrigerant during operation, and the number [i] (i=1, 2, . . . ) in parentheses indicates a pipe portion corresponding to a point i in the diagrams of FIGS. 5 to 7.

FIG. 2 illustrates a flow in a case where heating is performed by heating the indoor air in the indoor heat exchanger 2 and removing heat from the outside air in the outdoor heat exchanger 4 (hereinafter referred to as heating only operation). FIG. 3 illustrates a flow in a case where the indoor air is heated in the indoor heat exchanger 2, refrigerant is evaporated in one of the parallel heat exchangers (outdoor heat exchanger 4A in FIG. 3) constituting the outdoor heat exchanger 4 to remove heat from the outside air, and frost is heated in the other parallel heat exchanger (outdoor heat exchanger 4B in FIG. 3) to melt the frost that has formed on the outdoor heat exchanger 4B (hereinafter referred to as first simultaneous heating and defrosting operation). FIG. 4 illustrates a flow in a case where the indoor air is heated in the indoor heat exchanger 2, frost is heated in one of the parallel heat exchangers (outdoor heat exchanger 4A in FIG. 4) constituting the outdoor heat exchanger to melt the frost that has formed on the outdoor heat exchanger 4A, and refrigerant is evaporated in the other one of the parallel heat exchangers (outdoor heat exchanger 4B in FIG. 4) to remove heat from the outside air (hereinafter referred to as second simultaneous heating and defrosting operation). Incidentally, during these heating operations, the indoor heat exchanger 2 functions as a condenser, and the outdoor heat exchanger 4 functions as an evaporator. The same applies to the embodiments described later.

<Heating Only Operation>

Now, the flow of heating only operation will be described with reference to FIGS. 2 and 5. First, a low-temperature and low-pressure gas refrigerant sucked into the compressor 1 is compressed by the compressor 1, and discharged as a high-temperature and high-pressure gas refrigerant. Assuming that there is no entry and exit of heat from and to the surroundings, the compression of refrigerant in the compressor 1 is represented by an isentropic curve (from Point [1] to Point [2]) in the p-h diagram of FIG. 5. The high-temperature and high-pressure gas refrigerant discharged from the compressor 1 flows into the indoor heat exchanger 2, where the refrigerant condenses and liquefies by exchanging heat with the indoor air, and heats the indoors. Although the change of refrigerant in the indoor heat exchanger 2 takes place under substantially constant pressure, by taking pressure loss in the indoor heat exchanger 2 into consideration, the change is represented by a line that is slightly inclined and close to a horizontal line (from Point [2] to Point [3]) in the p-h diagram. Then, this refrigerant that has turned to a liquid state flows into the first flow rate control means 3, and is reduced in pressure into a two-phase gas-liquid state at low pressure. The change of refrigerant in the first flow rate control means 3 takes place under constant enthalpy, and is represented by a vertical line (from Point [3] to Point [4]) in the p-h diagram.

Then, after the refrigerant whose pressure has been reduced to low pressure branches off, the refrigerant passes through the first flow switching means E and flows into the outdoor heat exchangers 4A, 4B. Incidentally, the first flow switching means E and the second flow switching means F are switched in such a way that the refrigerant that has discharged from the first flow rate control means 3 branches off and flows into both of the outdoor heat exchangers 4A, 4B, and the refrigerant that has discharged from the outdoor heat exchangers 4A, 4B is sucked into the compressor 1. The refrigerant that has flowed into the outdoor heat exchangers 4A, 4B evaporates by exchanging heat with the outdoor air, and turns into a low-temperature and low-pressure gas state. The refrigerant then passes through the second flow switching means F, and is sucked into the compressor 1. Although the change of refrigerant in the outdoor heat exchangers 4A, 4B takes place under substantially constant pressure, by taking pressure loss in the outdoor heat exchangers 4A, 4B into consideration, the change is represented by a line that is slightly inclined and close to a horizontal line (from Point [4] to Point [1]) in the p-h diagram. A heating operation is performed as refrigerant circulates in the main circuit in this way. In this operation, when the outdoor air temperature is low, frost forms on the outdoor heat exchanger 4. As the operation is continued, even more frost forms, and the quantity of heat exchange decreases.

<First Simultaneous Heating and Defrosting Operation>

Next, the flow of first simultaneous heating and defrosting operation (heating operation in which the outdoor heat exchanger 4B is to be defrosted) will be described with reference to FIGS. 3 and 6. First, a high-temperature and high-pressure gas refrigerant discharged from the compressor 1 branches off, and a part of the refrigerant is supplied to the indoor heat exchanger 2 and the remainder flows to the first bypass pipe 6. The refrigerant that has flowed into the indoor heat exchanger 2 condenses and liquefies by exchanging heat with the indoor air, and heats the indoors. Although the change of refrigerant in the indoor heat exchanger 2 takes place under substantially constant pressure, by taking pressure loss in the indoor heat exchanger 2 into consideration, the change is represented by a line that is slightly inclined and close to a horizontal line (from Point [2] to Point [3]) in the p-h diagram.

Then, the refrigerant that has turned into a liquid state flows to the first flow rate control means 3 controlled based on the amount of subcooling at the outlet of the indoor heat exchanger 2, and is reduced in pressure. The change of refrigerant in the first flow rate control means 3 takes place under constant enthalpy, and is represented by a vertical line (from Point [3] to Point [4]) in the p-h diagram. The refrigerant whose pressure has been reduced passes through the main pipe 5, and flows into the first flow switching means E. Incidentally, the three-way valve 7A of the first flow switching means E is switched to the main circuit side, the three-way valve 7B is switched to the first bypass pipe 6 side, and all of the refrigerant discharging from the first flow rate control means 3 flows into the outdoor heat exchanger 4A. Then, the refrigerant in the main circuit that has flowed into the outdoor heat exchanger 4A evaporates and turns into a gas state by exchanging heat with the outdoor air, and is sucked into the compressor 1. Although the change of refrigerant in the outdoor heat exchanger 4A takes place under substantially constant pressure, by taking pressure loss in the outdoor heat exchanger 4A into consideration, the change is represented by a line that is slightly inclined and close to a horizontal line (from Point [4] to Point [1]) in the p-h diagram.

Then, the gas refrigerant from the main circuit sucked into the compressor 1 is raised to an intermediate pressure. The change of refrigerant at this time is represented as that from Point [1] to Point [5]. Then, as will be described later in detail, the refrigerant in the state of Point [5] that has been raised to the intermediate pressure in the compressor 1 mixes with a refrigerant that has been injected from the injection port 43. The change of refrigerant by this mixing takes place under constant pressure, and is represented by a horizontal line (from Point [5] to Point [8]) in the p-h diagram. Then, the refrigerant in the state of Point [8] is further compressed within the compressor 1 and changes from Point [8] to Point [2]. That is, the gas refrigerant raised to the intermediate pressure within the compressor 1 mixes with an intermediate-pressure refrigerant in a two-phase gas-liquid state injected into the compression chamber in which compression is taking place, and these refrigerants are compressed together and turn into the state of Point [2]. Then, the refrigerant in the state of Point [2] discharged from the compressor 1 flows into the indoor heat exchanger 2 again, thus completing one cycle. A heating operation is performed as refrigerant circulates in the main circuit in this way.

Meanwhile, the remainder of the high-temperature and high-pressure gas refrigerant discharged from the compressor 1 flows to the first bypass pipe 6, and in the second flow rate control means 41, the refrigerant is reduced in pressure to an intermediate pressure that is lower than the discharge pressure of the compressor 1 and higher than the suction pressure of the compressor 1. The change of refrigerant in the second flow rate control means 41 takes place under constant enthalpy, and is represented by a vertical line (from Point [2] to Point [6]) in the p-h diagram. The intermediate-pressure gas refrigerant whose pressure has been reduced passes through the first flow switching means E, and flows into the outdoor heat exchanger 4B, where the refrigerant condenses while melting frost that has formed on the outdoor heat exchanger 4B and changes into a two-phase gas-liquid state at intermediate pressure. Although the change of refrigerant in the outdoor heat exchanger 4B takes place under substantially constant pressure, by taking pressure loss in the outdoor heat exchanger 4B into consideration, the change is represented by a line that is slightly inclined and close to a horizontal line (from Point [6] to Point [7]) in the p-h diagram. At this time, the temperature of refrigerant in the outdoor heat exchanger 4B changes in a region above the 0° C. isothermal line illustrated in FIG. 6, until the refrigerant changes into a two-phase gas-liquid state.

The intermediate-pressure refrigerant in the two-phase gas-liquid state that has discharged from the outdoor heat exchanger 4B passes through the second flow switching means F and the second bypass pipe 40, and flows into the compressor 1 through the injection port 43. Then, the intermediate-pressure refrigerant in the two-phase gas-liquid state injected into the compressor 1 mixes with the gas refrigerant from the main circuit (the gas refrigerant that has flowed into the compressor 1 from the outdoor heat exchanger 4A and has been compressed to an intermediate pressure in the compressor 1) in the compressor 1 and evaporates and gasifies, and decreases in temperature. The change in which the intermediate-pressure refrigerant in the two-phase gas-liquid state evaporates and gasifies through this mixing takes place under constant pressure, and is represented by a horizontal line (from Point [7] to Point [8]) in the p-h diagram. Then, the refrigerant in the state of Point [8] is further compressed in the compressor 1 as described above, and changes to Point [2].

<Second Simultaneous Heating and Defrosting Operation>

Next, the flow of second simultaneous heating and defrosting operation (heating operation in which the outdoor heat exchanger 4A is to be defrosted) will be described with reference to FIGS. 4 and 7. First, a high-temperature and high-pressure gas refrigerant discharged from the compressor 1 branches off, and a part of the refrigerant is supplied to the indoor heat exchanger 2 and the remainder flows to the first bypass pipe 6. The refrigerant that has flowed into the indoor heat exchanger 2 condenses and liquefies by exchanging heat with the indoor air, and heats the indoors. Although the change of refrigerant in the indoor heat exchanger 2 takes place under substantially constant pressure, by taking pressure loss in the indoor heat exchanger 2 into consideration, the change is represented by a line that is slightly inclined and close to a horizontal line (from Point [2] to Point [3]) in the p-h diagram.

Then, the refrigerant that has turned into a liquid state flows into the first flow rate control means 3 controlled based on the amount of subcooling at the outlet of the indoor heat exchanger 2, and is reduced in pressure. The change of refrigerant in the first flow rate control means 3 takes place under constant enthalpy, and is represented by a vertical line (from Point [3] to Point [4]) in the p-h diagram. The refrigerant whose pressure has been reduced passes through the main pipe 5, and flows into the first flow switching means E. Incidentally, the three-way valve 7A of the first flow switching means E is switched to the first bypass pipe 6 side, and the three-way valve 7B is switched to the main circuit side, and all of the refrigerant discharging from the first flow rate control means 3 flows into the outdoor heat exchanger 4B. Then, the refrigerant that has flowed into the outdoor heat exchanger 4B evaporates and turns into a gas state by exchanging heat with the outdoor air, and is sucked into the compressor 1. Although the change of refrigerant in the outdoor heat exchanger 4B takes place under substantially constant pressure, by taking pressure loss in the outdoor heat exchanger 4B into consideration, the change is represented by a line that is slightly inclined and close to a horizontal line (from Point [4] to Point [1]) in the p-h diagram. Then, the gas refrigerant from the main circuit sucked into the compressor 1 is raised to an intermediate pressure. The change of refrigerant at this time is represented as that from Point [1] to Point [5]. Then, as will be described later in detail, the refrigerant in the state of Point [5] that has been raised to the intermediate pressure in the compressor 1 mixes with a refrigerant that has been injected from the injection port 43. The change of refrigerant by this mixing takes place under constant pressure, and is represented by a horizontal line (from Point [5] to Point [8]) in the p-h diagram. Then, the refrigerant in the state of Point [8] is further compressed in the compressor 1 and changes from Point [8] to Point [2]. That is, the gas refrigerant raised to the intermediate pressure in the compressor 1 mixes with an intermediate-pressure refrigerant in a two-phase gas-liquid state injected into the compression chamber in which compression is taking place, and these refrigerants are compressed together and turn into the state of Point [2]. Then, the refrigerant in the state of Point [2] discharged from the compressor 1 flows into the indoor heat exchanger 2 again, thus completing one cycle. A heating operation is performed as refrigerant circulates in the main circuit in this way.

Meanwhile, the remainder of the high-temperature and high-pressure gas refrigerant discharged from the compressor 1 flows to the first bypass pipe 6, and in the second flow rate control means 41, the refrigerant is reduced in pressure to an intermediate pressure that is lower than the discharge pressure of the compressor 1 and higher than the suction pressure of the compressor 1. The change of refrigerant in the second flow rate control means 41 takes place under constant enthalpy, and is represented by a vertical line (from Point [2] to Point [6]) in the p-h diagram. The intermediate-pressure gas refrigerant whose pressure has been reduced passes through the first flow switching means E, and flows into the outdoor heat exchanger 4A, where the refrigerant condenses while melting frost that has formed on the outdoor heat exchanger 4A and changes into a two-phase gas-liquid state at intermediate pressure. Although the change of refrigerant in the outdoor heat exchanger 4A takes place under substantially constant pressure, by taking pressure loss in the outdoor heat exchanger 4A into consideration, the change is represented by a line that is slightly inclined and close to a horizontal line (from Point [6] to Point [7]) in the p-h diagram. At this time, the temperature of refrigerant in the outdoor heat exchanger 4A changes in a region above the 0° C. isothermal line illustrated in FIG. 7, until the refrigerant changes into a two-phase gas-liquid state.

The intermediate-pressure refrigerant in the two-phase gas-liquid state that has discharged from the outdoor heat exchanger 4A passes through the second flow switching means F and the second bypass pipe 40, and flows into the compressor 1 through the injection port 43. Then, the intermediate-pressure refrigerant in the two-phase gas-liquid state injected into the compressor 1 mixes with the gas refrigerant from the main circuit (the gas refrigerant that has flowed into the compressor 1 from the outdoor heat exchanger 4A and has been compressed to an intermediate pressure within the compressor 1) in the compressor 1 and evaporates and gasifies, and decreases in temperature. The change in which the intermediate-pressure refrigerant in the two-phase gas-liquid state evaporates and gasifies through this mixing takes place under constant pressure, and is represented by a horizontal line (from Point [7] to Point [8]) in the p-h diagram. Then, the refrigerant in the state of Point [8] is further compressed in the compressor 1 as described above, and changes to Point [2].

<Method of Regulating Discharge Temperature of Compressor 1>

Next, a method of regulating the discharge temperature of the compressor 1 will be described. When the discharge temperature of the compressor 1 measured by the temperature sensor 42 is higher than or equal to the upper limit temperature for ensuring the reliability of the compressor 1, the opening degree of the first flow rate control means 3 is increased, and when the discharge temperature is lower than or equal to the upper limit value, the opening degree of the first flow rate control means 3 is decreased. During heating operation at low outside air temperature, the discharge temperature of the compressor 1 rises. Accordingly, an abnormal rise in the discharge temperature of the compressor 1 is prevented by checking the discharge temperature of the compressor 1 in this way.

As described above, the heat pump according to Embodiment 1 has three operation modes, the heating only operation, the first simultaneous heating and defrosting operation, and the second simultaneous heating and defrosting operation. When frost forms and performance degradation due to a decrease in air flow or a decrease in evaporating temperature begins to occur in the outdoor heat exchanger 4, indoor heating can be continuously performed by alternately executing the first simultaneous heating and defrosting operation and the second simultaneous heating and defrosting operation. Also, the following effect is obtained in addition to this effect. That is, injection of the refrigerant used for defrosting is performed not on the suction side of the compressor 1 but at some midpoint of the compression process in the compressor 1, and thus there is no need to lower the pressure of the refrigerant used for defrosting to the suction temperature. Therefore, in the compressor 1, only the refrigerant used for heating that circulates in the main circuit needs to be raised from low pressure to high pressure, and as for the injected intermediate-pressure refrigerant in the two-phase gas-liquid state, its pressure only needs to be raised from intermediate pressure to high pressure. Therefore, the load to be done by the compressor 1 decreases, thereby improving the efficiency of the heat pump (heating capacity/amount of compressor's work). As a result, a contribution can be also made to the energy saving effect.

Further, the refrigerant in the two-phase gas-liquid state flowing from the injection port 43 to the compressor 1 is heated by the intermediate-pressure gas refrigerant that is undergoing compression, and changes into a gas state within the compressor 1. Thus, the reliability of the heat pump improves. Also, in Embodiment 1 mentioned above, the enthalpy difference of the refrigerant used for defrosting (the length of the line segment from Point [6] to Point [7] in FIG. 6) can be increased in comparison to the related art, which allows defrosting to be performed at a small refrigerant flow rate, thereby improving energy efficiency. Therefore, there is also an effect of global warming prevention due to the improved energy efficiency.

Also, the temperature sensor 42 that measures the discharge temperature of refrigerant from the compressor 1 is provided, and the first flow rate control means 3 is controlled in accordance with the discharge temperature. Therefore, a rise in discharge temperature under low outside air temperature conditions can be suppressed, thereby improving the reliability of the compressor 1.

Also, while the first flow switching means E and the second flow switching means F are each represented by two three-way valves in Embodiment 1 mentioned above, each of the flow switching means may be configured by four two-way valves or flow rate control means.

Also, while the second flow rate control means 41 is provided in the first bypass pipe 6 in Embodiment 1 mentioned above, the second flow rate control means 41 may be provided in the second bypass pipe 40 so that the flow rate of refrigerant is controlled after the refrigerant discharges from the outdoor heat exchanger 4 in which defrosting is performed in the first simultaneous heating and defrosting operation and the second simultaneous heating and defrosting operation. At this time, the second flow rate control means 41 may be configured by a capillary in order to suppress pressure vibration or refrigerant noise caused by flow of a refrigerant that is in a two-phase gas-liquid state at the inlet of the second flow rate control means 41.

Also, the flow rate control means may be provided in both the first bypass pipe 6 and the second bypass pipe 40 to control the flow rate of the refrigerant used for defrosting.

Embodiment 2 of the Invention

In Embodiment 2, instead of the configuration in Embodiment 1 in which a part of the refrigerant discharged from the compressor 1 is bypassed to flow into the outdoor heat exchanger 4, a compressor is additionally provided on the discharge side of the compressor 1 of Embodiment 1, and a part of the refrigerant discharged from the additionally provided compressor is bypassed to flow into the outdoor heat exchanger 4. Also, while the refrigerant that has been used for defrosting is injected into the compressor 1 in Embodiment 1, in Embodiment 2, the refrigerant that has been used for defrosting is merged at the main pipe between the compressor 1 and the additionally provided compressor.

Figure 8:
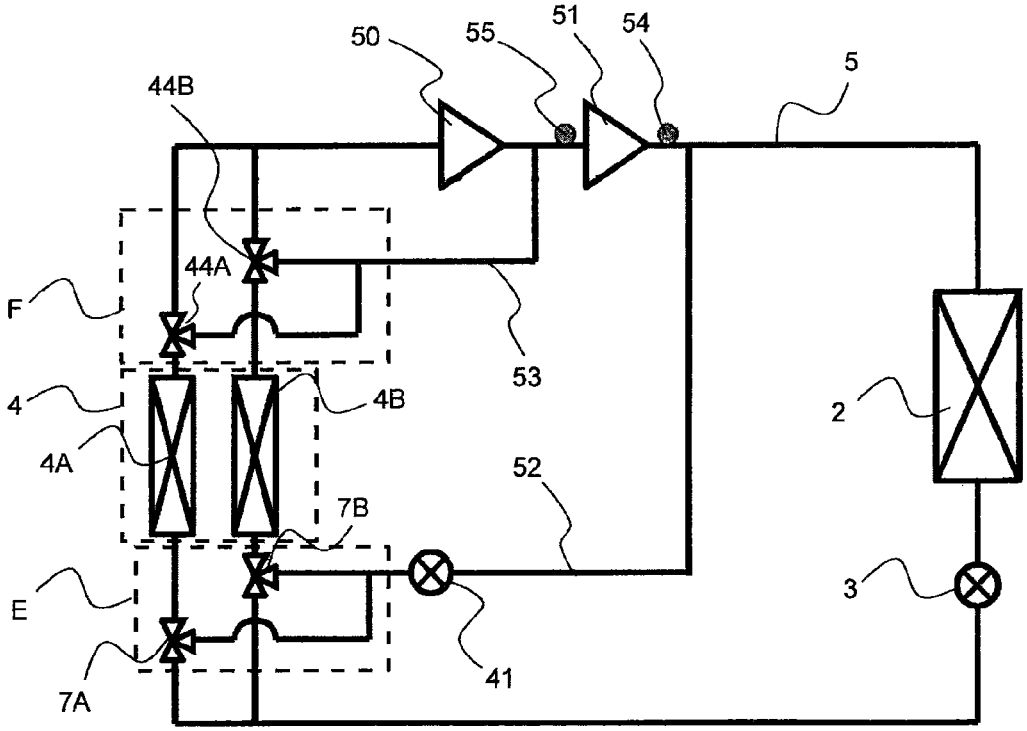
FIG. 8 illustrates the refrigerant circuit of a heat pump according to Embodiment 2 of the present invention.

FIG. 8 illustrates the refrigerant circuit of an air-conditioning device, as an example of a heat pump according to Embodiment 2 of the present invention. In FIG. 8, portions that are identical to those in FIG. 1 are denoted by identical reference signs.

The refrigerant circuit of the heat pump according to Embodiment 2 has a main circuit in which a first compressor 50, a second compressor 51, the indoor heat exchanger 2, the first flow rate control means (electronic expansion valve in this example) 3 that can open and close, and the outdoor heat exchanger 4 are sequentially connected by the main pipe 5. The outdoor heat exchanger 4 is divided into a plurality of parallel heat exchangers, which in this example are two parallel heat exchangers 4A and 4B. The portion of the main circuit where the outdoor heat exchanger 4 is arranged branches off into a plurality of (two in this example) parts of a parallel circuit in accordance with the number of parallel heat exchangers. Also, the main circuit includes the first flow switching means E having the three-way valves 7A, 7B. The three-way valves 7A, 7B switch the flow of refrigerant entering the parallel heat exchangers 4A, 4B (hereinafter, referred to as outdoor heat exchangers 4A, 4B) to the main circuit or a first bypass pipe 52 described later. Also, the main circuit includes the second flow switching means F having the three-way valves 44A, 44B, which switch the flow of refrigerant discharging from the outdoor heat exchangers 4A, 4B to the main circuit or a second bypass pipe 53 described later.

One end of the first bypass pipe 52 is connected to the main pipe 5 connecting the second compressor 51 to the indoor heat exchanger 2, and the other end thereof branches off into two parts that are connected to the main pipe 5 on respective inlet side of the outdoor heat exchangers 4A, 4B. The first bypass pipe 52 is connected with the second flow rate control means 41 controlling the flow rate of refrigerant. One end of the second bypass pipe 53 is connected to the main pipe 5 between the first compressor 50 and the second compressor 51, and the other end thereof branches off into two parts that are connected to the main pipe 5 on respective outlet side of the outdoor heat exchangers 4A, 4B. Incidentally, the main circuit refers to a portion of the entire refrigerant circuit illustrated in FIG. 8 excluding the first bypass pipe 52 and the second bypass pipe 53.

A first temperature sensor 54 measuring the discharge temperature of the refrigerant discharged from the second compressor 51 is provided at the outlet of the second compressor 51 of the main circuit. Also, a second temperature sensor 55 measuring the temperature of the refrigerant sucked into the second compressor 51 is provided at the inlet of the second compressor 51 of the main circuit. Detection signals from the first temperature sensor 54 and second temperature sensor 55 are outputted to control means (not illustrated). The control means (not illustrated) is further connected with the first flow rate control means 3, the first flow switching means E, and the second flow switching means F. The control means controls the first flow rate control means 3, the first flow switching means E, and the second flow switching means F in accordance with each operation mode described later or the detection signals from the first temperature sensor 54 and second temperature sensor 55.

Figure 9:
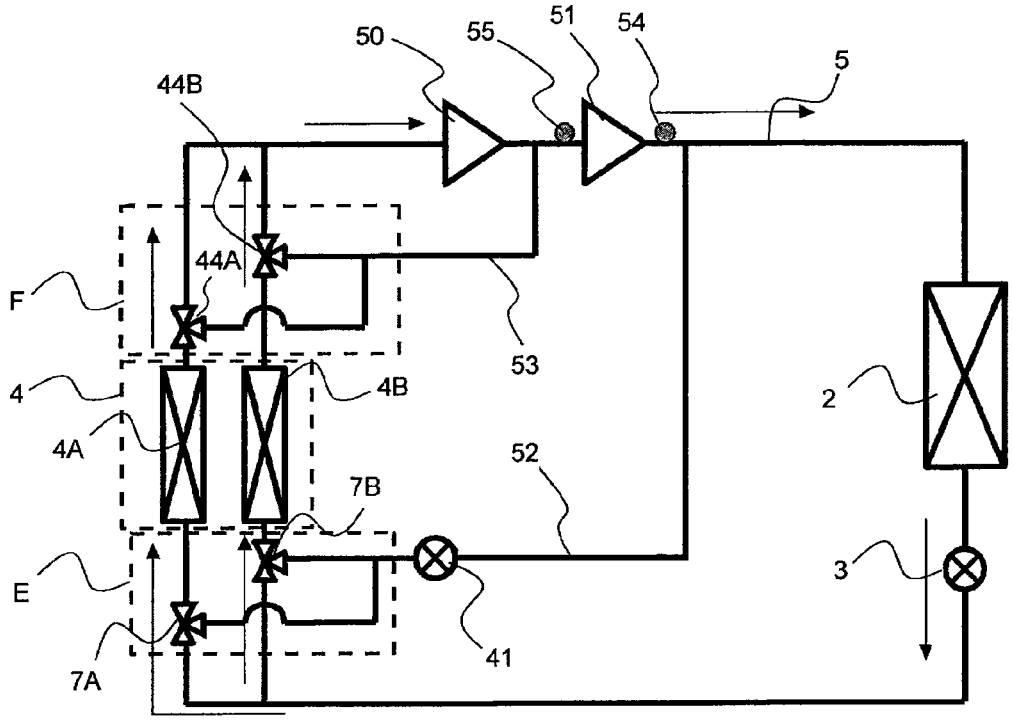
FIG. 9 illustrates the flow of refrigerant during heating only operation of the heat pump according to Embodiment 2 of the present invention.
Figure 10:
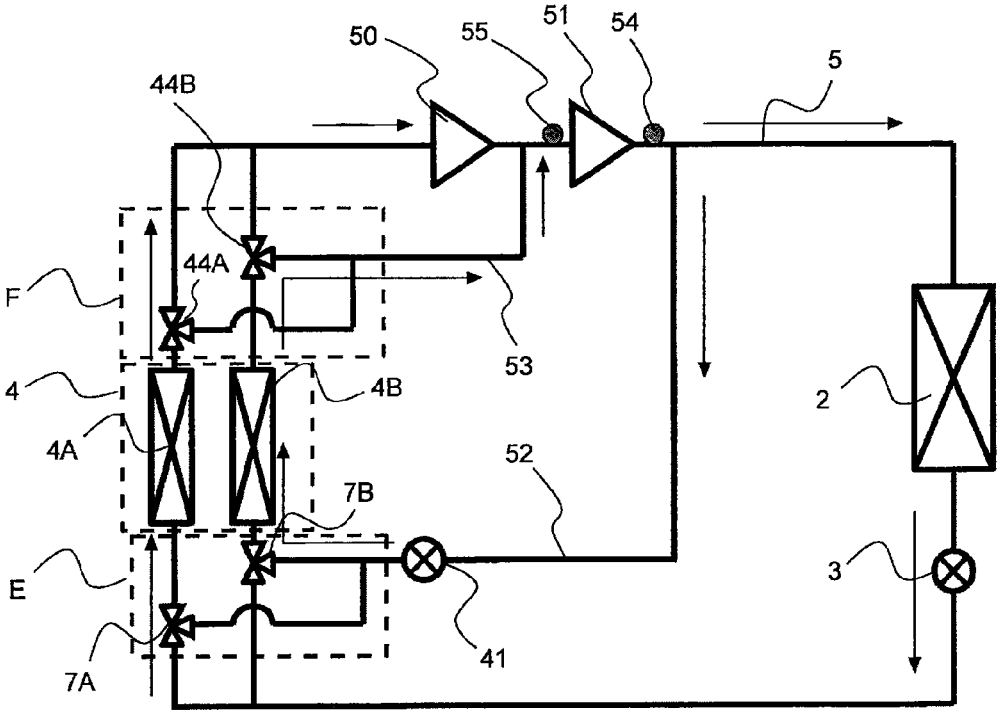
FIG. 10 illustrates the flow of refrigerant during first simultaneous heating and defrosting operation of the heat pump according to Embodiment 2 of the present invention.
Figure 11:
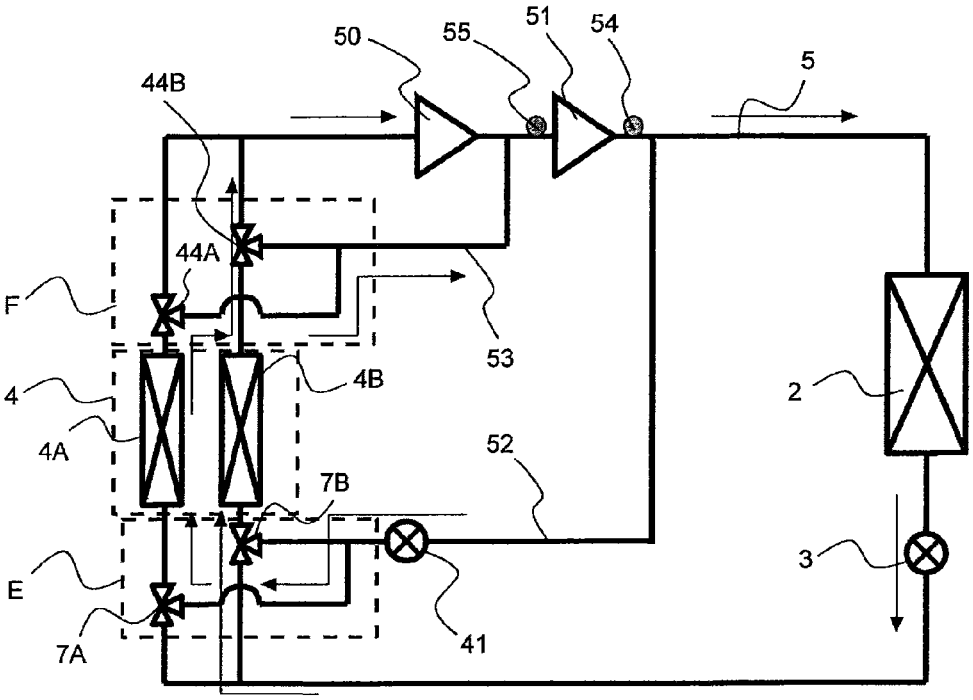
FIG. 11 illustrates the flow of refrigerant during second simultaneous heating and defrosting operation of the heat pump according to Embodiment 2 of the present invention.

Next, the flow of refrigerant in this device will be described with reference to FIGS. 9 to 11. FIG. 9 illustrates a flow in a case where heating is performed by heating the indoor air in the indoor heat exchanger 2 and removing heat from the outside air in the outdoor heat exchanger (hereinafter referred to as heating only operation). FIG. 10 illustrates a flow in a case where the indoor air is heated in the indoor heat exchanger 2, refrigerant is evaporated in one of the parallel heat exchangers (outdoor heat exchanger 4A in the drawing) constituting the outdoor heat exchanger to remove heat from the outside air, and frost is heated in the other parallel heat exchanger (outdoor heat exchanger 4B in the drawing) to melt the frost that has formed on the outdoor heat exchanger 4B (hereinafter referred to as first simultaneous heating and defrosting operation). FIG. 11 illustrates a flow in a case where the indoor air is heated in the indoor heat exchanger 2, frost is heated in one of the parallel heat exchangers (outdoor heat exchanger 4A in the drawing) constituting the outdoor heat exchanger to melt the frost that has formed on the outdoor heat exchanger 4A, and refrigerant is evaporated in the other one of the parallel heat exchangers (outdoor heat exchanger 4B in the drawing) to remove heat from the outside air (hereinafter referred to as second simultaneous heating and defrosting operation).

<Heating Only Operation>

Now, the flow of heating only operation will be described first with reference to FIG. 9. First, a low-temperature and low-pressure gas refrigerant is compressed by the first compressor 50, and discharged as an intermediate-pressure gas refrigerant. Thereafter, the refrigerant is sucked into the second compressor 51, where the refrigerant is compressed again and turns into a high-temperature and high-pressure gas refrigerant. The operation in which this high-temperature and high-pressure gas refrigerant returns to the first compressor 50 so that the refrigerant circulates is the same as in Embodiment 1.

<First Simultaneous Heating and Defrosting Operation>

Next, the flow of first simultaneous heating and defrosting operation (heating operation in which the outdoor heat exchanger 4B is to be defrosted) will be described with reference to FIG. 10. First, an intermediate-pressure gas refrigerant is compressed by the second compressor 51, and discharged as a high-temperature and high-pressure gas refrigerant. The operation until the high-temperature and high-pressure gas refrigerant discharged from the second compressor 51 is sucked into the first compressor 50 is the same as in Embodiment 1. A low-temperature and low-pressure gas refrigerant sucked into the first compressor 50 is compressed in the first compressor 50 and discharged, and is mixed with an intermediate-pressure refrigerant in a two-phase gas-liquid state flowing through the second bypass pipe 53. Through this mixing, the intermediate-pressure refrigerant in the two-phase gas-liquid state flowing through the second bypass pipe 53 is heated and evaporates, and a refrigerant in a gas state is sucked into the second compressor 51.

<Second Simultaneous Heating and Defrosting Operation>

Next, the flow of second simultaneous heating and defrosting operation (heating operation in which the outdoor heat exchanger 4A is to be defrosted) will be described with reference to FIG. 11. First, an intermediate-pressure gas refrigerant is compressed by the second compressor 51, and discharged as a high-temperature and high-pressure gas refrigerant. The operation until the high-temperature and high-pressure gas refrigerant discharged from the second compressor 51 is sucked into the first compressor 50 is the same as in Embodiment 1. A low-temperature and low-pressure gas refrigerant sucked into the first compressor 50 is compressed in the first compressor 50 and discharged, and mixes with an intermediate-pressure refrigerant in a two-phase gas-liquid state flowing through the second bypass pipe 53. Through this mixing, the intermediate-pressure refrigerant in the two-phase gas-liquid state flowing through the second bypass pipe 53 is heated and evaporates, and a refrigerant in a gas state is sucked into the second compressor 51.

<Method of Regulating Discharge Temperature and Suction Temperature of Second Compressor 51>

Next, a method of regulating the discharge temperature and the suction temperature of the second compressor 51 will be described. When the suction temperature of the second compressor 51 measured by the second temperature sensor 55 is higher than or equal to the lower limit temperature for ensuring the reliability of the second compressor 51, the opening degree of the second flow rate control means 41 is increased, and when the suction temperature is lower than or equal to the lower limit value, the opening degree of the second flow rate control means 41 is decreased. Consequently, a refrigerant in a two-phase gas-liquid state is not sucked into the second compressor 51, and a failure of the second compressor 51 can be prevented, which advantageously improves the reliability of the heat pump.

Also, when the discharge temperature of the second compressor 51 measured by the first temperature sensor 54 is higher than or equal to the upper limit temperature for ensuring the reliability of the second compressor 51, the opening degree of the second flow rate control means 41 is increased, and when the discharge temperature is lower than or equal to the upper limit value, the opening degree of the second flow rate control means 41 is decreased. Consequently, an abnormal rise in the discharge temperature of the second compressor 51 during heating operation at low outside air temperature can be prevented, thereby improving the reliability of the second compressor 51.

In the heat pump configured as described above, the same effect as in Embodiment 1 can be obtained, and the absence of the injection port 43 in the first compressor 50 makes it possible to reduce loss for mixing or dead volume in comparison to Embodiment 1, which advantageously improves energy efficiency.

Also, the second temperature sensor 55 that measures the discharge temperature of refrigerant from the first compressor 50 is provided, and the second flow rate control means 41 is controlled in accordance with the discharge temperature. Consequently, a refrigerant in a two-phase gas-liquid state is not sucked into the second compressor 51, and a failure of the second compressor 51 can be prevented, which advantageously improves the reliability of the heat pump.

Embodiment 3 of the Invention

Figure 12:
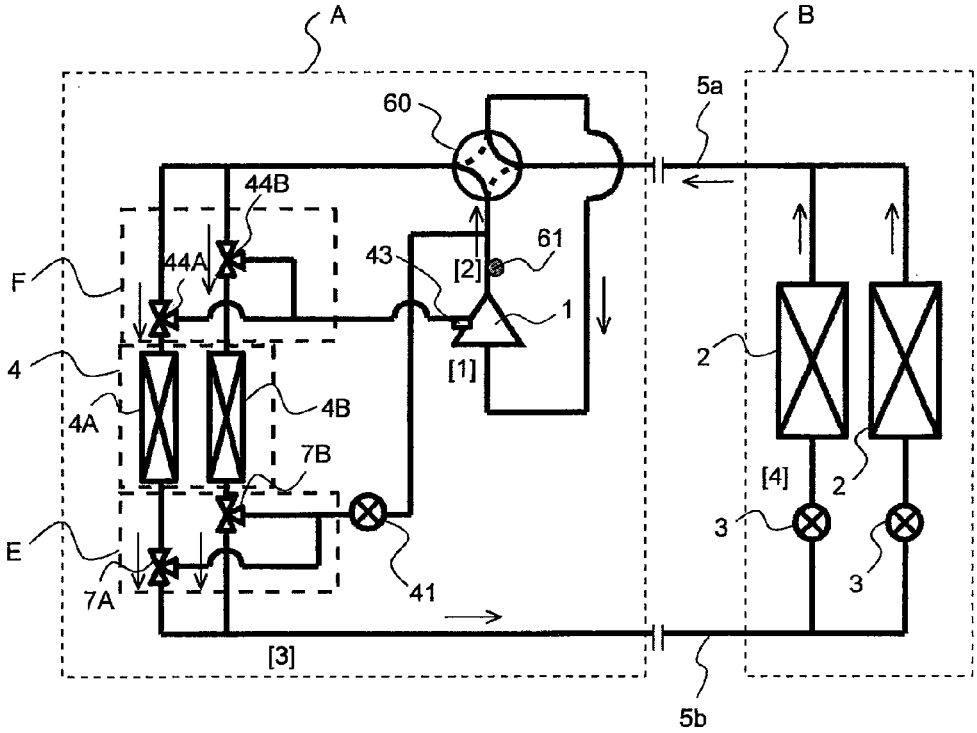
FIG. 12 illustrates the refrigerant circuit of an air-conditioning device, as an example of a heat pump according to Embodiment 3 of the present invention.

FIG. 12 illustrates the refrigerant circuit of an air-conditioning device, as an example of a heat pump according to Embodiment 3 of the present invention. In FIG. 12, portions that are identical to those in FIG. 1 are denoted by identical reference signs. The air-conditioning device of Embodiment 3 basically includes the heat pump of Embodiment 1 illustrated in FIG. 1, and is further configured to be able to also perform a cooling operation. That is, the air-conditioning device is provided with a four-way valve 60 that supplies the gas refrigerant discharged from the compressor 1 to either the outdoor heat exchanger 4 or indoor heat exchanger 2.

As illustrated in FIG. 12, the air-conditioning device according to Embodiment 3 includes an outdoor unit A, an indoor unit B, and a first pipe 5*a* and a second pipe 5*b* that connect those units. The air-conditioning device is a multi-type air-conditioning unit in which a plurality of indoor units are connected to a single outdoor unit A. The first pipe 5*a* and the second pipe 5*b* are each a part of the main pipe 5 constituting the main circuit. The outdoor unit A includes the compressor 1, the four-way valve 60, the outdoor heat exchanger 4A, the outdoor heat exchanger 4B, the first flow switching means E, the second flow switching means F, and the second flow rate control means 41. Also, the indoor unit B has a configuration in which a plurality of (two in this example) pairs of indoor heat exchanger 2 and first flow rate control means 3 are connected in parallel.

Figure 13:
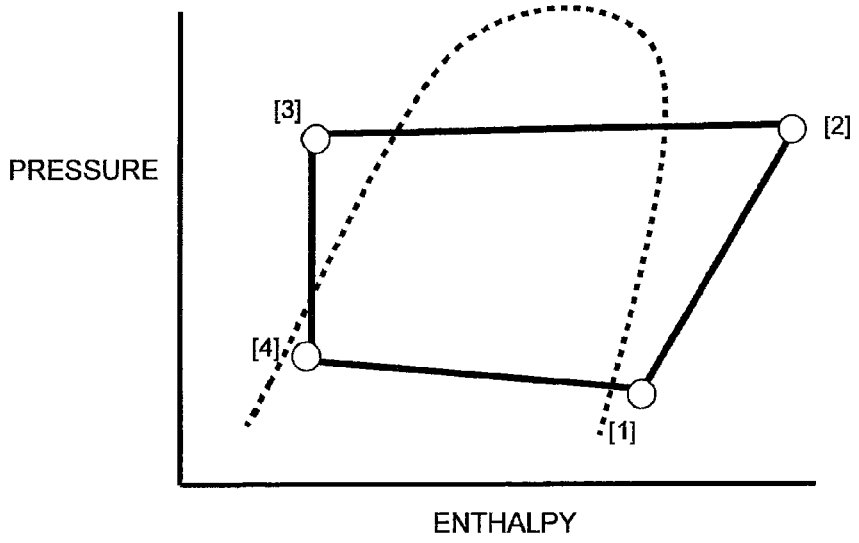
FIG. 13 illustrates the flow of refrigerant during cooling only operation of the refrigerant circuit of an air-conditioning device, as an example of the heat pump according to Embodiment 3 of the present invention.

Next, a description will be given with reference to FIG. 12 that illustrates the flow of refrigerant in this device, and FIG. 13 that is a p-h diagram (diagram illustrating the relationship between the pressure and enthalpy of refrigerant). FIG. 12 illustrates a flow in a case where the indoor air is cooled in the indoor heat exchanger 2 and rejected to the outside air in the outdoor heat exchanger 4 (hereinafter referred to as cooling only operation). Incidentally, as for the heating only operation, the first simultaneous heating and defrosting operation, and the second simultaneous heating and defrosting operation, the flow of refrigerant is the same as in Embodiment 1.

<Cooling Only Operation>

Now, the flow of cooling only operation will be described with reference to FIG. 12. During the cooling only operation, the four-way valve 60 is switched to the state indicated by solid lines in FIG. 12. Also, the first flow switching means E and the second flow switching means F are switched in such a way that the refrigerant that has discharged from the first flow rate control means 3 branches off and flows into both of the outdoor heat exchangers 4A, 4B, and the refrigerant that has discharged from the outdoor heat exchangers 4A, 4B is sucked into the compressor 1. First, a low-temperature and low-pressure gas refrigerant is compressed by the compressor 1, and discharged as a high-temperature and high-pressure gas refrigerant. After the high-temperature and high-pressure gas refrigerant discharged from the compressor 1 passes through the four-way valve 60, and branches off, the respective branched refrigerants pass through the second flow switching means F and flow into the indoor heat exchanger 4A and the outdoor heat exchanger 4B, where the refrigerants condense and liquefy by exchanging heat with the outside air from the outdoors, and reject heat outdoors. Then, the refrigerants that have turned into a liquid state merge after passing through the first flow switching means E. The merged refrigerant discharges from the outdoor unit A, passes through the second pipe 5*b*, and flows into the indoor unit B. Then, the refrigerant that has flowed into the indoor unit B branches off, and each of the branched refrigerants flows into the first flow rate control means 3 and is reduced in pressure into a two-phase gas-liquid state at low pressure. Then, the refrigerants reduced to low pressure flow into the indoor heat exchanger 2, evaporate by exchanging heat with the indoor air, and cool the indoors. The low-temperature and low-pressure refrigerants in a gas state that has separately discharged from the indoor heat exchanger 2 merge, and the merged refrigerant discharges from the indoor unit B, passes through the first pipe 5*a*, and flows into the outdoor unit A. The refrigerant passes through the four-way valve 60 again, and is sucked into the compressor 1. A cooling operation is performed as refrigerant circulates in the main circuit in this way.

In the heat pump configured as described above, the same effect as in Embodiment 1 is obtained, and a cooling operation is also possible.

Embodiment 4 of the Invention

Figure 14:
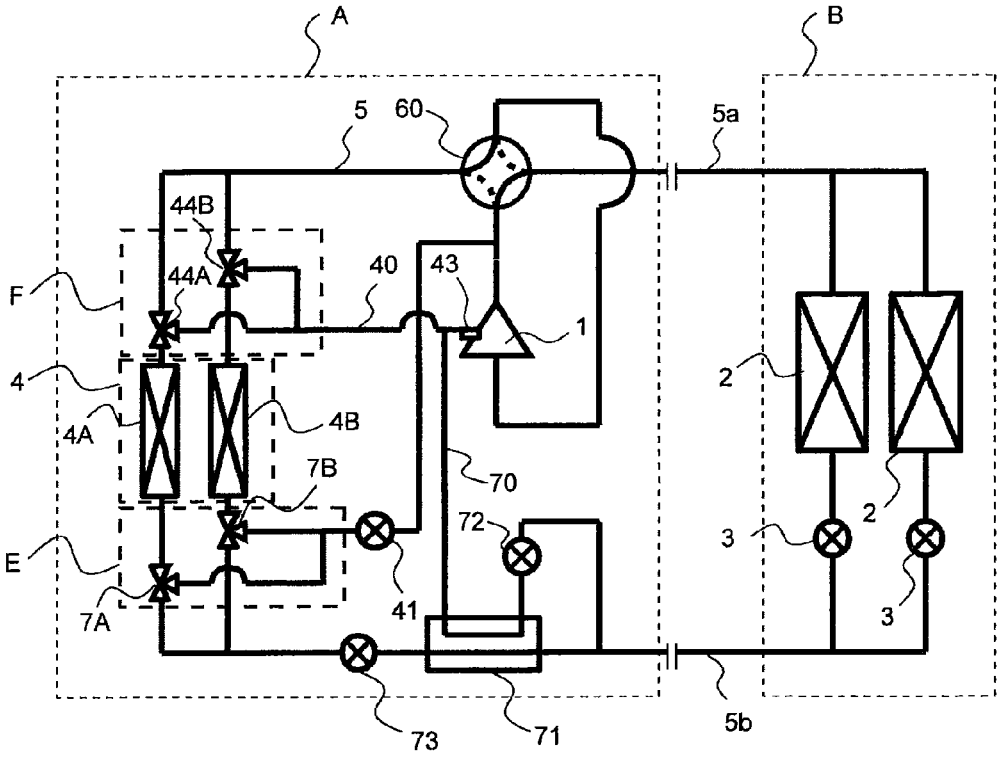
FIG. 14 illustrates the refrigerant circuit of an air-conditioning device, as an example of a heat pump according to Embodiment 4 of the present invention.

FIG. 14 illustrates the refrigerant circuit of an air-conditioning device, as an example of a heat pump according to Embodiment 4 of the present invention. Hereinafter, an embodiment of the present invention will be described with reference to the drawings. In FIG. 14, portions that are identical to those of Embodiment 3 illustrated in FIG. 12 are denoted by identical reference signs. Since the basic configuration in Embodiment 4 is the same as Embodiment 1, the following description will mainly focus on the differences.

In Embodiment 4, the configuration in Embodiment 3 is further provided with a third bypass pipe 70, a heat exchanger 71, a third flow rate control means 72, and a fourth flow rate control means 73. The third bypass pipe 70 branches off a part of the refrigerant flowing from the first flow rate control means 3 to the outdoor heat exchanger 4 serving as an evaporator from the main pipe 5, and flow the part of the refrigerant to the second bypass pipe 40. The heat exchanger 71 exchanges heat between the refrigerant flowing through the third bypass pipe 70 and the refrigerant flowing through the main pipe 5. The third flow rate control means 72 controls the flow rate of refrigerant flowing through the third bypass pipe 70. The fourth flow rate control means 73 controls the flow rate of refrigerant flowing through the main pipe 5 connecting the heat exchanger 71 to the outdoor heat exchanger 4.

Figure 20:
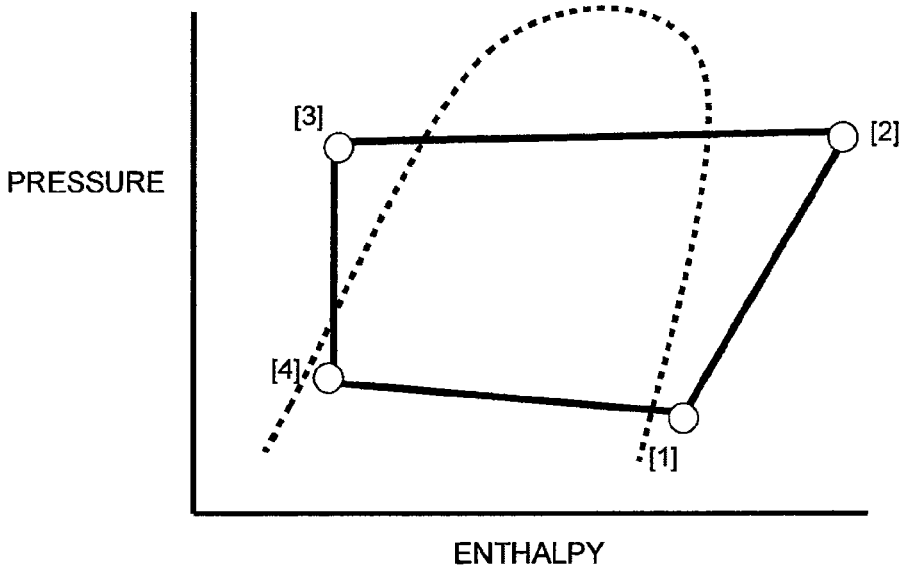
FIG. 20 illustrates the relationship between the pressure and enthalpy of refrigerant during first heating only operation of an air-conditioning device, as an example of the heat pump according to Embodiment 4 of the present invention.
Figure 21:
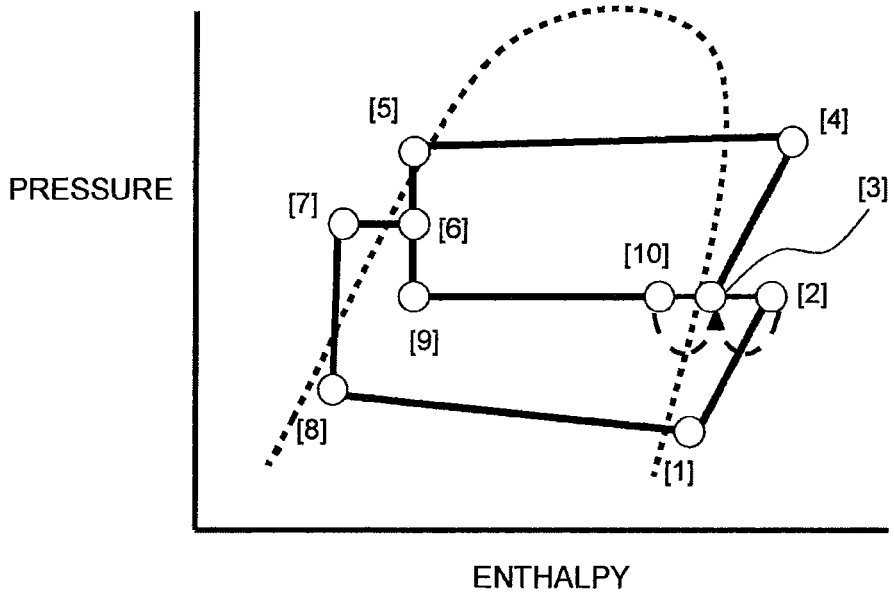
FIG. 21 illustrates the relationship between the pressure and enthalpy of refrigerant during second heating only operation of an air-conditioning device, as an example of the heat pump according to Embodiment 4 of the present invention.
Figure 22:
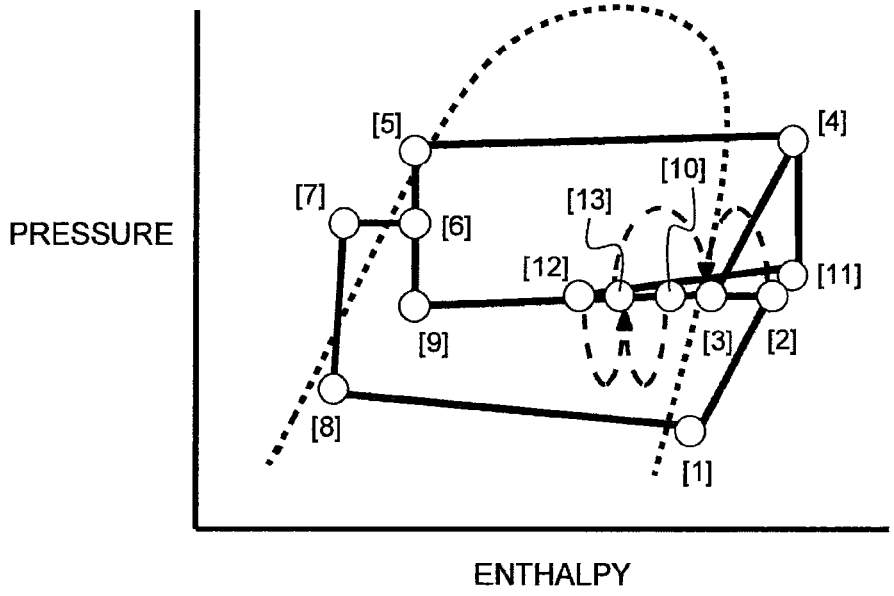
FIG. 22 illustrates the relationship between the pressure and enthalpy of refrigerant during first simultaneous heating and defrosting operation, as an example of the heat pump according to Embodiment 4 of the present invention.

Next, a description will be given with reference to FIGS. 15 to 19 that illustrate the flow of refrigerant in this device, and FIGS. 20 to 22 that are p-h diagrams (diagrams illustrating the relationship between the pressure and enthalpy of refrigerant). In FIGS. 15 to 19, solid lines indicate the flow of refrigerant during operation, and in FIGS. 16 to 18, the number [i] (i=1, 2, . . . ) in parentheses indicates a pipe portion corresponding to a point i in the diagrams of FIGS. 20 to 22.

Figure 15:
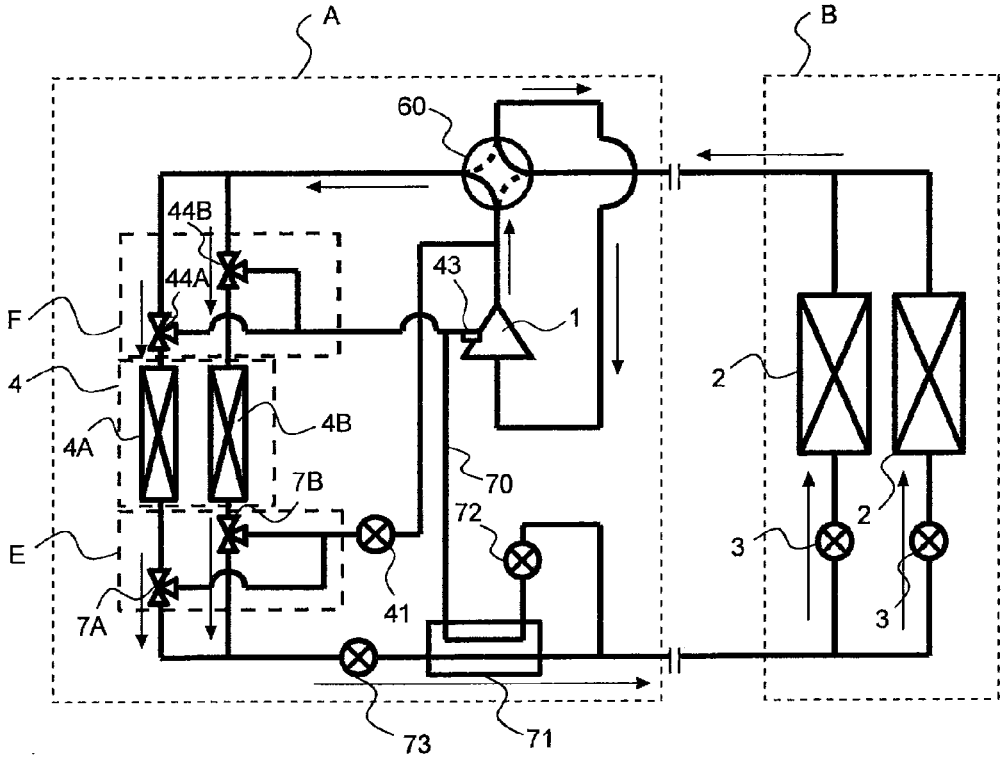
FIG. 15 illustrates the flow of refrigerant during cooling only operation of an air-conditioning device, as an example of the heat pump according to Embodiment 4 of the present invention.
Figure 16:
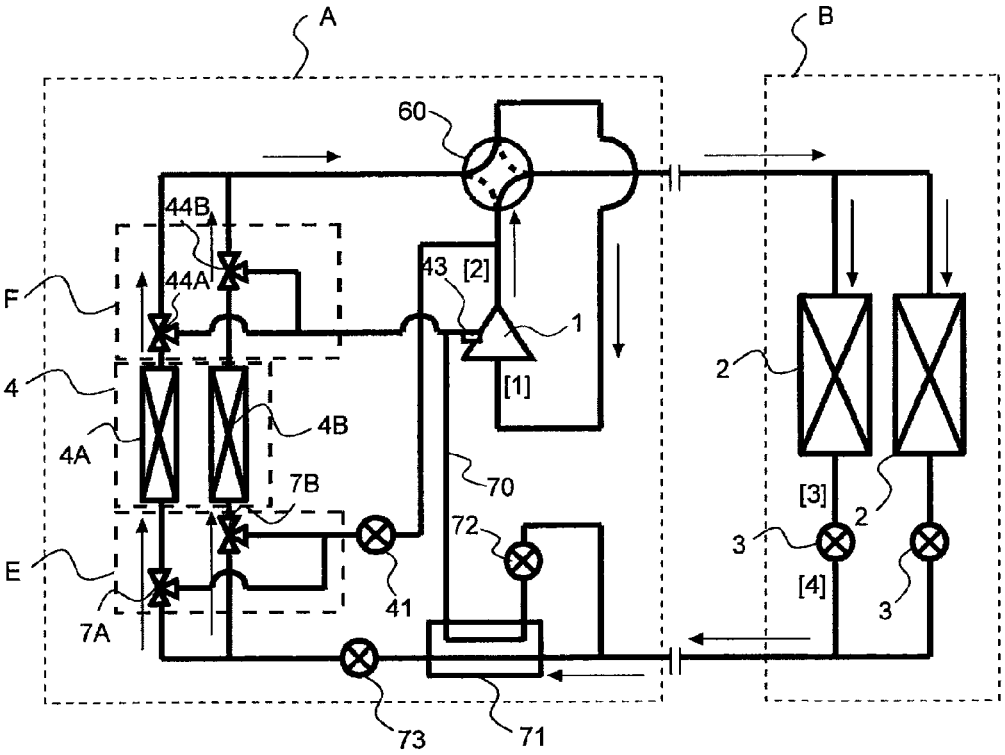
FIG. 16 illustrates the flow of refrigerant during first heating only operation of an air-conditioning device, as an example of the heat pump according to Embodiment 4 of the present invention.
Figure 17:
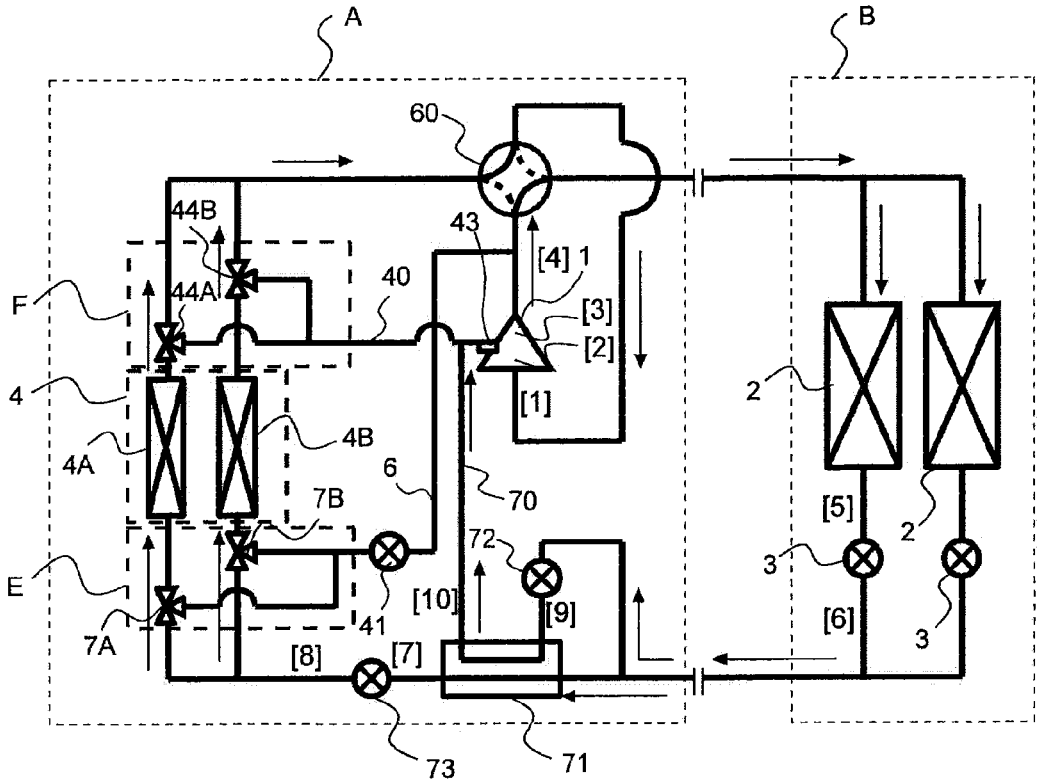
FIG. 17 illustrates the flow of refrigerant during second heating only operation of an air-conditioning device, as an example of the heat pump according to Embodiment 4 of the present invention.

FIG. 15 illustrates a flow in a case where cooling is performed by cooling the indoor air in the indoor heat exchanger and rejecting heat to the outside air in the outdoor heat exchanger (hereinafter referred to as cooling only operation). FIG. 16 illustrates a flow in a case where heating is performed by heating the indoor air in the indoor heat exchanger and removing heat from the outside air in the outdoor heat exchanger (hereinafter referred to as first heating only operation). FIG. 17 illustrates a flow in a case where, while heating is performed by heating the indoor air in the indoor heat exchanger and removing heat from the outside air in the outside heat exchanger, a part of refrigerant in the main circuit is bypassed, and the refrigerant is injected into the compressor in which compression is taking place (hereinafter referred to as second heating only operation).

Figure 18:
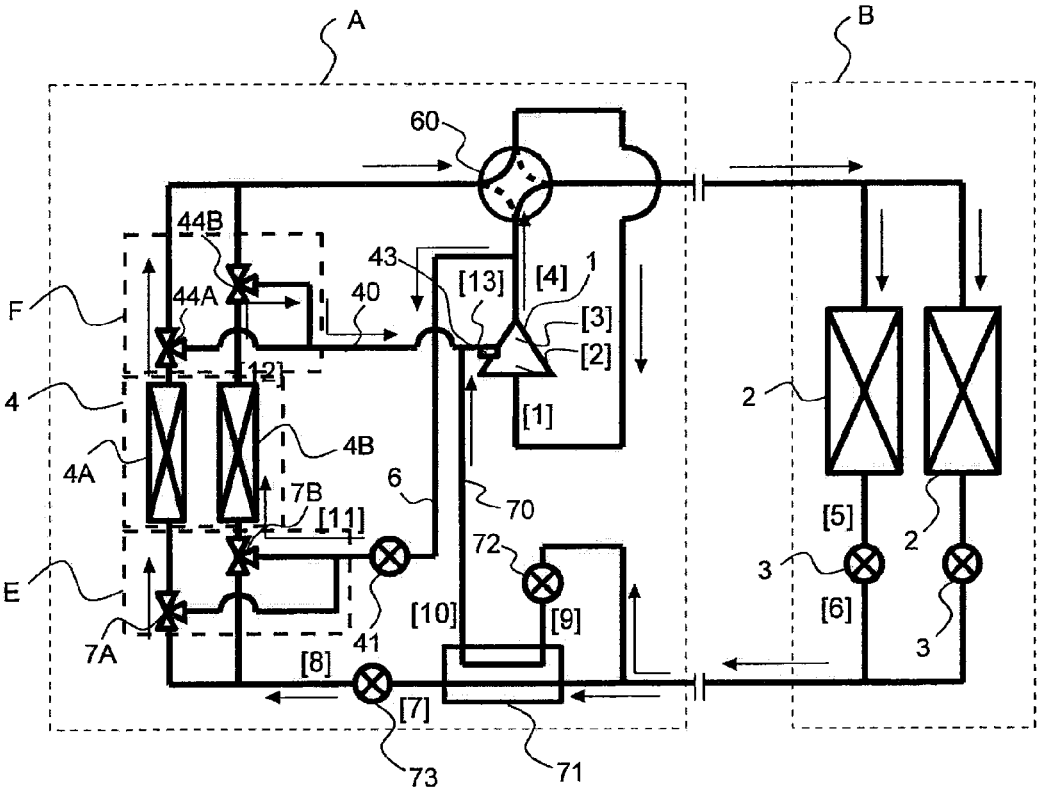
FIG. 18 illustrates the flow of refrigerant during first simultaneous heating and defrosting operation of an air-conditioning device, as an example of the heat pump according to Embodiment 4 of the present invention.

FIG. 18 illustrates a flow in a case where the indoor air is heated in the indoor heat exchanger, refrigerant is evaporated in one of the parallel heat exchangers (outdoor heat exchanger 4A in FIG. 18) constituting the outdoor heat exchanger to remove heat from the outside air, and in the other parallel heat exchanger (outdoor heat exchanger 4B in FIG. 18), while frost is heated to melt the frost that has formed on the outdoor heat exchanger 4B, a part of refrigerant is injected into the refrigerant that is undergoing compression as in the first heating only operation (hereinafter referred to as first simultaneous heating and defrosting operation).

Figure 19:
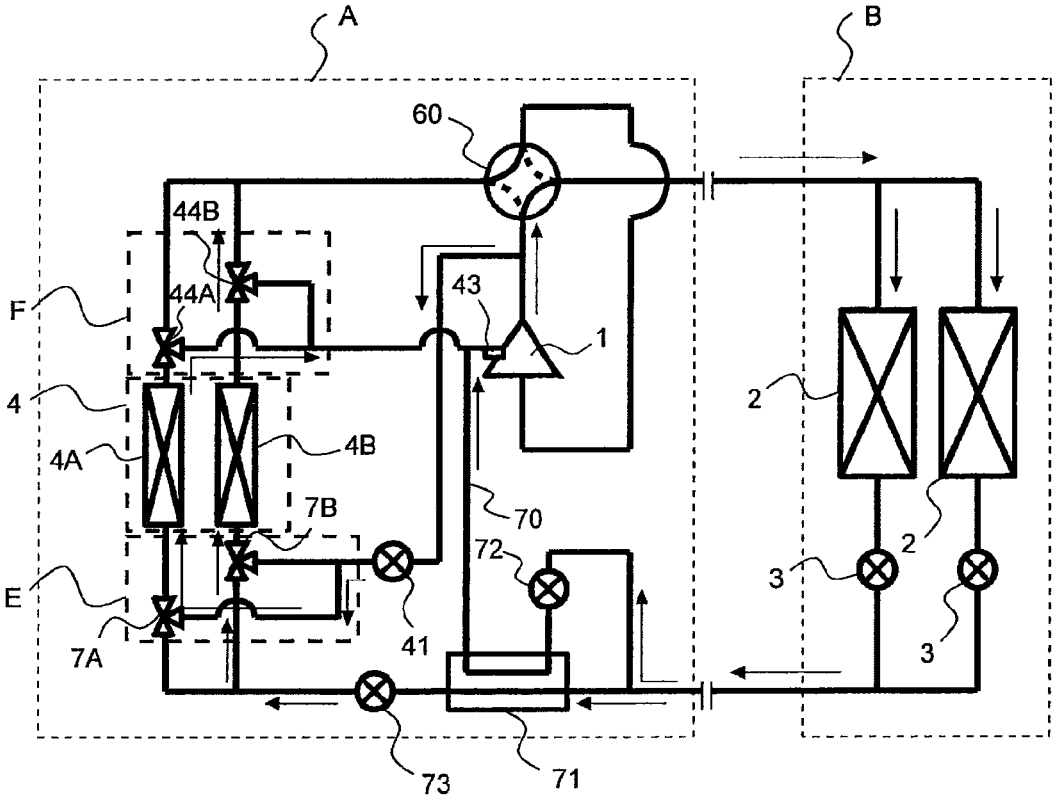
FIG. 19 illustrates the flow of refrigerant during second simultaneous heating and defrosting operation of an air-conditioning device, as an example of the heat pump according to Embodiment 4 of the present invention.

FIG. 19 illustrates a flow in a case where the indoor air is heated in the indoor heat exchanger, frost is heated in one of the parallel heat exchangers (outdoor heat exchanger 4A in FIG. 19) constituting the outdoor heat exchanger to melt the frost that has formed on the outdoor heat exchanger 4A, and while refrigerant is evaporated in the other one of the parallel heat exchangers (outdoor heat exchanger 4B in FIG. 19) to remove heat from the outside air, a part of refrigerant is injected into the refrigerant that is undergoing compression as in the first heating only operation (hereinafter referred to as second simultaneous heating and defrosting operation).

<Cooling Only Operation>

Now, the flow of cooling only operation will be described with reference to FIG. 15. During the cooling only operation, the four-way valve 60 is switched to the state indicated by solid lines in FIG. 15. Also, the third flow rate control means 72 is fully closed, and the fourth flow rate control means 73 is fully open. Further, the first flow switching means E and the second flow switching means F are switched in such a way that the refrigerant that has discharged from the first flow rate control means 3 branches off and flows into both of the outdoor heat exchangers 4A, 4B, and the refrigerant that has discharged from the outdoor heat exchangers 4A, 4B is sucked into the compressor 1.

First, a low-temperature and low-pressure gas refrigerant is compressed by the compressor 1, and discharged as a high-temperature and high-pressure gas refrigerant. After the high-temperature and high-pressure gas refrigerant discharged from the compressor 1 passes through the four-way valve 60, and branches off, the branched refrigerants pass through the second flow switching means F and respectively flow into the indoor heat exchanger 4A and the outdoor heat exchanger 4B, where the refrigerants condense and liquefy by exchanging heat with the outside air from the outdoors, and reject heat outdoors. Then, the refrigerants that have turned into a liquid state merge after passing through the first flow switching means E. Thereafter, the merged refrigerant passes through the fourth flow rate control means 73 and the heat exchanger 71, flows into the first flow rate control means 3, and is reduced in pressure into a two-phase gas-liquid state at low pressure. Then, the refrigerant reduced to low pressure branches off, and then flows into the indoor heat exchanger 2, evaporates by exchanging heat with the indoor air, and cools the indoors. The refrigerant that has turned into in a gas state at low temperature and low pressure passes through the four-way valve 60 again, and is sucked into the compressor 1, thus completing one cycle. A cooling operation is performed as refrigerant circulates in the main circuit in this way.

<First Heating Only Operation>

Next, the flow of first heating only operation will be described with reference to FIGS. 16 and 20. During the first heating only operation, the four-way valve 60 is switched to the state indicated by solid lines in FIG. 16. Also, the third flow rate control means 72 is fully closed, and the fourth flow rate control means 73 is fully open. Further, the first flow switching means E and the second flow switching means F are switched in such a way that the refrigerant that has discharged from the first flow rate control means 3 branches off and flows into both of the outdoor heat exchangers 4A, 4B, and the refrigerant that has discharged from the outdoor heat exchangers 4A, 4B is sucked into the compressor 1. First, a low-temperature and low-pressure gas refrigerant is compressed by the compressor 1, and discharged as a high-temperature and high-pressure gas refrigerant. Assuming that there is no entry and exit of heat from and to the surroundings, the compression of refrigerant in the compressor 1 is represented by an isentropic curve (from Point [1] to Point [2]) in the p-h diagram of FIG. 20. The high-temperature and high-pressure gas refrigerant discharged from the compressor 1 passes through the four-way valve 60 and flows into the indoor heat exchanger 2, where the refrigerant condenses and liquefies by exchanging heat with the indoor air, and heats the indoors. Although the change of refrigerant in the indoor heat exchanger 2 takes place under substantially constant pressure, by taking pressure loss in the indoor heat exchanger 2 into consideration, the change is represented by a line that is slightly inclined and close to a horizontal line (from Point [2] to Point [3]) in the p-h diagram. Then, this refrigerant that has turned into a liquid state flows to the first flow rate control means 3, and is reduced in pressure into a two-phase gas-liquid state at low pressure. The change of refrigerant in the first flow rate control means 3 takes place under constant enthalpy, and is represented by a vertical line (from Point [3] to Point [4]) in the p-h diagram.

Then, the refrigerant whose pressure has been reduced to low pressure passes through the heat exchanger 71 and the fourth flow rate control means 73, and after branching off, the refrigerant passes through the first flow switching means E, and flows into the outdoor heat exchangers 4A, 4B. The refrigerant that has evaporated and turned into a low-temperature and low-pressure gas state by exchanging heat with the outdoor air passes through the second flow switching means F, and is sucked into the compressor 1. Although the change of refrigerant in the outdoor heat exchangers 4A, 4B takes place under substantially constant pressure, by taking pressure loss in the outdoor heat exchangers 4A, 4B into consideration, the change is represented by a line that is slightly inclined and close to a horizontal line (from Point [4] to Point [1]) in the p-h diagram. A heating operation is performed as refrigerant circulates in the main circuit in this way. Incidentally, when the outdoor air temperature is low, frost forms on the outdoor heat exchangers 4A, 4B, and as the operation is continued, even more frost forms, and the quantity of heat exchange decreases.

<Second Heating Only Operation>

Next, the flow of second heating only operation will be described with reference to FIGS. 17 and 21. During the second heating only operation, the four-way valve 60 is switched to the state indicated by solid lines in FIG. 17. Also, the opening degrees of the first flow rate control means 3, third flow rate control means 72, and fourth flow rate control means 73 are reduced. Further, the first flow switching means E and the second flow switching means F are switched in such a way that the refrigerant that has discharged from the first flow rate control means 3 branches off and flows into both of the outdoor heat exchangers 4A, 4B, and the refrigerant that has discharged from the outdoor heat exchangers 4A, 4B is sucked into the compressor 1.

First, a high-temperature and high-pressure gas refrigerant discharged from the compressor 1 passes through the four-way valve 60 and flows into the indoor heat exchanger 2, where the refrigerant condenses and liquefies by exchanging heat with the indoor air, and heats the indoors. Although the change of refrigerant in the indoor heat exchanger 2 takes place under substantially constant pressure, by taking pressure loss in the indoor heat exchanger 2 into consideration, the change is represented by a line that is slightly inclined and close to a horizontal line (from Point [4] to Point [5]) in the p-h diagram of FIG. 21. Then, this refrigerant that has turned into a liquid state flows to the first flow rate control means 3, and is reduced in pressure. The change of refrigerant in the first flow rate control means 3 takes place under constant enthalpy, and is represented by a vertical line (from Point [5] to Point [6]) in the p-h diagram. Then, the refrigerant whose pressure has been reduced branches off. A part of the refrigerant flows through the main pipe 5 as it is and flows into the heat exchanger 71, and the remainder flows to the third bypass pipe 70, is reduced in pressure in the third flow rate control means 72, and then flows into the heat exchanger 71.

The refrigerant that has flowed into the heat exchanger 71 from the main pipe 5 is cooled by exchanging heat in the heat exchanger 71 with the refrigerant from the third bypass pipe 70, and decreases in temperature. The change of refrigerant in the heat exchanger 71 takes place under substantially constant pressure, and is represented by a horizontal line (from Point [6] to Point [7]) in the p-h diagram. The refrigerant in the main circuit that is in liquid form and has decreased in temperature flows into the fourth flow rate control means 73, and is reduced in pressure into a two-phase gas-liquid state at low pressure. The change of refrigerant in the fourth flow rate control means 73 takes place under constant enthalpy, and is represented by a vertical line (from Point [7] to Point [8]) in the p-h diagram. Then, after the refrigerant whose pressure has been reduced to low pressure branches off, the refrigerant passes through the first flow switching means E, and flows into the outdoor heat exchangers 4A, 4B. The refrigerant that has evaporated and turned into a low-temperature and low-pressure gas state by exchanging heat with the outdoor air in the outdoor heat exchangers 4A, 4B passes through the second flow switching means F and the four-way valve 60, and is sucked into the compressor 1, thus completing one cycle. A heating operation is performed as refrigerant circulates in the main circuit in this way. Although the change of refrigerant in the outdoor heat exchanger 4 takes place under substantially constant pressure, by taking pressure loss in the outdoor heat exchangers 4 into consideration, the change is represented by a line that is slightly inclined and close to a horizontal line (from Point [8] to Point [1]) in the p-h diagram.

Meanwhile, the refrigerant that has flowed into the third bypass pipe 70 is reduced in pressure in the third flow rate control means 72 as described above, and turns into a two-phase gas-liquid state. The change of refrigerant in the third flow rate control means 72 takes place under constant enthalpy, and is represented by a vertical line (from Point [6] to [9]) in the p-h diagram. The refrigerant in the two-phase gas-liquid state evaporates in the heat exchanger 71 by exchanging heat with the refrigerant flowing through the main pipe 5. By taking pressure loss in the heat exchanger 71 into consideration, the change of refrigerant in the heat exchanger 71 is represented by a line that is slightly inclined and close to a horizontal line (from Point [9] to Point [10]) in the p-h diagram.

The refrigerant in the third bypass pipe 70 that has discharged from the heat exchanger 71 is injected into the compressor chamber in which compression is taking place, from the injection port 43 of the compressor 1. As the refrigerant that has flowed into the compressor 1 from the injection port 43 merges with the refrigerant that is undergoing compression, the refrigerant changes from Point [10] to Point [3] in the p-h diagram. Meanwhile, as the refrigerant that has flowed into the compressor 1 from the main pipe 5 merges with the refrigerant that has flowed into from the injection port 43, the refrigerant changes from Point [2] to Point [3] in the p-h diagram. In this second heating only operation, as in the first heating only operation, when the outdoor air temperature is low, frost forms on the outdoor heat exchanger 4, and as the operation is continued, even more frost forms, and the quantity of heat exchange decreases.

<First Simultaneous Heating and Defrosting Operation>

Next, the flow of first simultaneous heating and defrosting operation (heating operation in which the outdoor heat exchanger 4B is to be defrosted) will be described with reference to FIGS. 18 and 22. During the first simultaneous heating and defrosting operation, the four-way valve 60 is switched to the state indicated by solid lines in FIG. 18. Also, the opening degrees of the first flow rate control means 3, third flow rate control means 72, and fourth flow rate control means 73 are reduced. Further, the three-way valve 7A of the first flow switching means E is switched to the main circuit side, the three-way valve 7B is switched to the first bypass pipe 6 side, and all of the refrigerant discharging from the fourth flow rate control means 73 flows into the outdoor heat exchanger 4A. Also, the three-way valve 44A of the second flow switching means F is switched to the main circuit side, and the three-way valve 44B is switched to the second bypass pipe 40 side.

First, a high-temperature and high-pressure gas refrigerant discharged from the compressor 1 branches off, and a part of the refrigerant is supplied to the indoor heat exchanger 2 and the remainder flows to the first bypass pipe 6. The refrigerant that has flowed into the indoor heat exchanger 2 condenses and liquefies by exchanging heat with the indoor air, and heats the indoors. Although the change of refrigerant in the indoor heat exchanger 2 takes place under substantially constant pressure, by taking pressure loss in the indoor heat exchanger 2 into consideration, the change is represented by a line that is slightly inclined and close to a horizontal line (from Point [4] to Point [5]) in the p-h diagram. Then, this refrigerant that has turned into a liquid state flows into the first flow rate control means 3 controlled based on the amount of subcooling at the outlet of the indoor heat exchanger 2, and is reduced in pressure. The change of refrigerant in the first flow rate control means 3 takes place under constant enthalpy, and is represented by a vertical line (from Point [5] to Point [6]) in the p-h diagram. Then, the refrigerant whose pressure has been reduced branches off. A part of the refrigerant flows through the main pipe 5 as it is and flows into the heat exchanger 71, and the remainder flows into the third bypass pipe 70, is reduced in pressure in the third flow rate control means 72, and then flows into the heat exchanger 71.

The refrigerant that has flowed into the heat exchanger 71 from the main pipe 5 is cooled by exchanging heat in the heat exchanger 71 with the refrigerant from the third bypass pipe 70, and decreases in temperature. The change of refrigerant in the heat exchanger 71 takes place under substantially constant pressure, and is represented by a horizontal line (from Point [6] to Point [7]) in the p-h diagram. The refrigerant in the main circuit that is in liquid form and has decreased in temperature flows into the fourth flow rate control means 73, and is reduced in pressure into a two-phase gas-liquid state at low pressure. The change of refrigerant in the fourth flow rate control means 73 takes place under constant enthalpy, and is represented by a vertical line (from Point [7] to Point [8]) in the p-h diagram. Then, after the refrigerant whose pressure has been reduced to low pressure branches off, the refrigerant passes through the first flow switching means E, and flows into the outdoor heat exchanger 4A that is one of the outdoor heat exchangers. The refrigerant evaporates and turns into a gas state by exchanging heat with the outdoor air, and is sucked into the compressor 1. Although the change of refrigerant in the outdoor heat exchanger 4A takes place under substantially constant pressure, by taking pressure loss in the outdoor heat exchangers 4A into consideration, the change is represented by a line that is slightly inclined and close to a horizontal line (from Point [8] to Point [1]) in the p-h diagram.

Then, the gas refrigerant from the main circuit sucked into the compressor 1 is raised to an intermediate pressure. The change of refrigerant at this time is represented as that from Point [1] to Point [2]. Then, as will be described later in detail, the refrigerant in the state of Point [2] that has been raised to the intermediate pressure in the compressor 1 mixes with a refrigerant that has been injected from the injection port 43. The change of refrigerant by this mixing is represented as that from Point [2] to Point [3] in the p-h diagram.

The refrigerant from the main circuit sucked into the compressor 1 is compressed in the compressor 1 together with the refrigerant from the injector port 43, and changes as Point [3] to Point [4]. Then, the refrigerant in the state of Point [4] discharged from the compressor 1 flows into the indoor heat exchanger 2 again, thus completing one cycle. A heating operation is performed as refrigerant circulates in the main circuit in this way.

Meanwhile, the remainder of the high-temperature and high-pressure gas refrigerant discharged from the compressor 1 flows to the first bypass pipe 6, and in the second flow rate control means 41, the refrigerant is reduced to an intermediate pressure that is lower than the discharge pressure of the compressor 1 and higher than the suction pressure of the compressor 1. The change of refrigerant in the second flow rate control means 41 takes place under constant enthalpy, and is represented by a vertical line (from Point [4] to Point [11]) in the p-h diagram. The intermediate-pressure gas refrigerant whose pressure has been reduced passes through the first flow switching means E, and flows into the outdoor heat exchanger 4B, where the refrigerant condenses while melting frost that has formed on the outdoor heat exchanger 4B and changes into a two-phase gas-liquid state at intermediate pressure. Although the change of refrigerant in the outdoor heat exchanger 4B takes place under substantially constant pressure, by taking pressure loss in the outdoor heat exchanger 4B into consideration, the change is represented by a line that is slightly inclined and close to a horizontal line (from Point [11] to Point [12]) in the p-h diagram.

The intermediate-pressure refrigerant in the two-phase gas-liquid state that has passed through the outdoor heat exchanger 4B passes through the second flow switching means F and the second bypass pipe 40, and merges with the refrigerant flowing through the third bypass pipe 70. The change of refrigerant by this merging is represented as that from Point [12] to Point [13]. Then, the merged refrigerant flows into the compressor 1 from the injection port 43. The intermediate-pressure refrigerant in the two-phase gas-liquid state injected into the compressor 1 from the injection port 43 mixes with the gas refrigerant from the main circuit (the gas refrigerant that has flowed into the compressor 1 from the outdoor heat exchanger 4A and has been compressed to an intermediate pressure within the compressor 1) in the compressor 1 and evaporates and gasifies, and decreases in temperature. The change in which the intermediate-pressure refrigerant in the two-phase gas-liquid state evaporates and gasifies through this mixing takes place under constant pressure, and is represented by a horizontal line (from Point [13] to Point [3]) in the p-h diagram.

Then, the refrigerant in the state of Point [3] is further compressed in the compressor 1 as described above, and changes to Point [4]. Incidentally, the change of the refrigerant that has flowed to the third bypass pipe 70 is the same as in the second heating only operation.

<Second Simultaneous Heating and Defrosting Operation>

In a second simultaneous heating and defrosting operation (heating operation in which the outdoor heat exchanger 4A is to be defrosted), the switching of the first flow switching means E and the second flow switching means F is reversed from that in the case of the first simultaneous heating and defrosting operation, so that frost is melted in the outdoor heat exchanger 4A, and in the outdoor heat exchanger 4B, refrigerant is evaporated to reject heat to the outdoor air. Since the operation is otherwise the same as the first simultaneous heating and defrosting operation, its description is omitted.

As described above, in the air-conditioning device of Embodiment 4, in addition to the effect of Embodiment 3, the following effect is obtained because a part of the refrigerant going from the first flow rate control means 3 toward the outdoor heat exchanger 4 serving as an evaporator is bypassed to pass through the heat exchanger 71 via the third flow rate control means 72, and is thereafter injected into the compressor 1. That is, the refrigerant in the main pipe 5 is cooled by exchanging heat with the refrigerant in the third bypass pipe 70 in the heat exchanger 71, the enthalpy of the refrigerant in the main circuit decreases (the length of the line segment from Point [6] to Point [7] in the p-h diagram), and the efficiency of refrigerant can be increased by an amount corresponding to the decrease in entropy. Therefore, heating capacity is advantageously improved in the second heating only operation, the first simultaneous heating and defrosting operation, and the second simultaneous heating and defrosting operation in which injection is performed.

Incidentally, while the foregoing description of Embodiment 4 is directed to a case where components such as the heat exchanger 71 are provided to an air-conditioning device that is capable of cooling operation or heating operation by switching of the four-way valve 60, the components may be provided to Embodiment 1.

Figure 23:
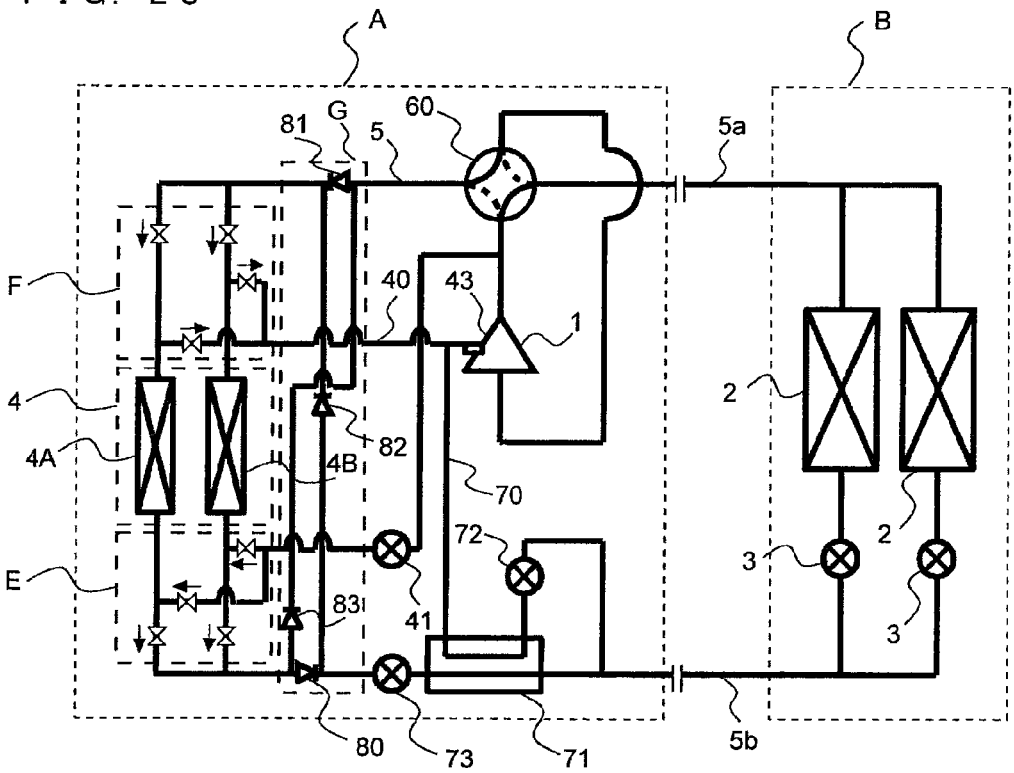
FIG. 23 illustrates the refrigerant circuit of another air-conditioning device, as an example of the heat pump according to Embodiment 4 of the present invention.

Also, as illustrated in FIG. 23, the circuit configuration may be such that the outdoor heat exchanger 4 is combined in a bridged configuration together with a third flow switching means G having four check valves, so that the flow direction of the refrigerant flowing through the outdoor heat exchanger 4 is one direction irrespective of the operation mode. This configuration advantageously makes it possible to use two-way switching valves that cause refrigerant to flow in only one direction, which are simpler in seal structure than two-way switching valves that cause refrigerant to flow in two directions, as the first flow rate switching means E and the second flow rate switching means F. By switching the two-way switching valves as appropriate, operations in the same operation modes as in Embodiment 4 are possible. Incidentally, arrows depicted near the two-way switching valves in the drawing each indicate the flow direction of refrigerant. Also, while FIG. 23 illustrates an example of configuration in which the third flow switching means G is combined with the configuration in Embodiment 4, the same operational effect can be obtained also by combining the third flow switching means G with the configuration in Embodiment 3 illustrated in FIG. 12.

Embodiment 5 of the Invention

Figure 24:
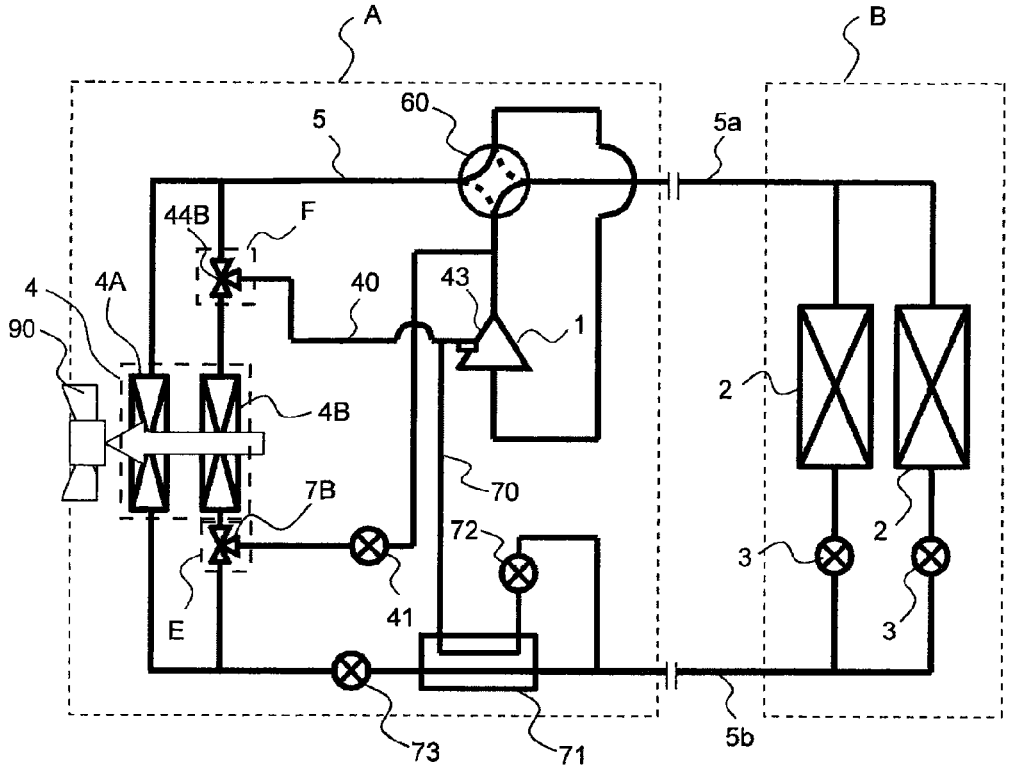
FIG. 24 illustrates the refrigerant circuit of an air-conditioning device, as an example of a heat pump according to Embodiment 5 of the present invention.

FIG. 24 illustrates the refrigerant circuit of an air-conditioning device, as an example of a heat pump according to Embodiment 5 of the present invention. Hereinafter, the embodiment of the present invention will be described with reference to the drawings. In FIG. 24, portions that are identical to those of Embodiment 4 illustrated in FIG. 14 are denoted by identical reference signs. Since the basic configuration in Embodiment 5 is the same as Embodiment 4, the following description will mainly focus on the differences.

In Embodiment 5, the configuration in Embodiment 4 is further provided with a fan 90. The fan 90 causes the air that is made to exchange heat with the refrigerant to flow sequentially from the outdoor heat exchanger 4B to the outdoor heat exchanger 4A. Incidentally, in Embodiment 5, the second simultaneous heating and defrosting operation aimed at defrosting the outdoor heat exchanger 4A located on the downstream side of the flow of air from the fan 90 is not performed. Thus, the pipes, the three-way valve 7A, and the three-way valve 44A required for the second simultaneous heating and defrosting operation are removed.

Figure 25:
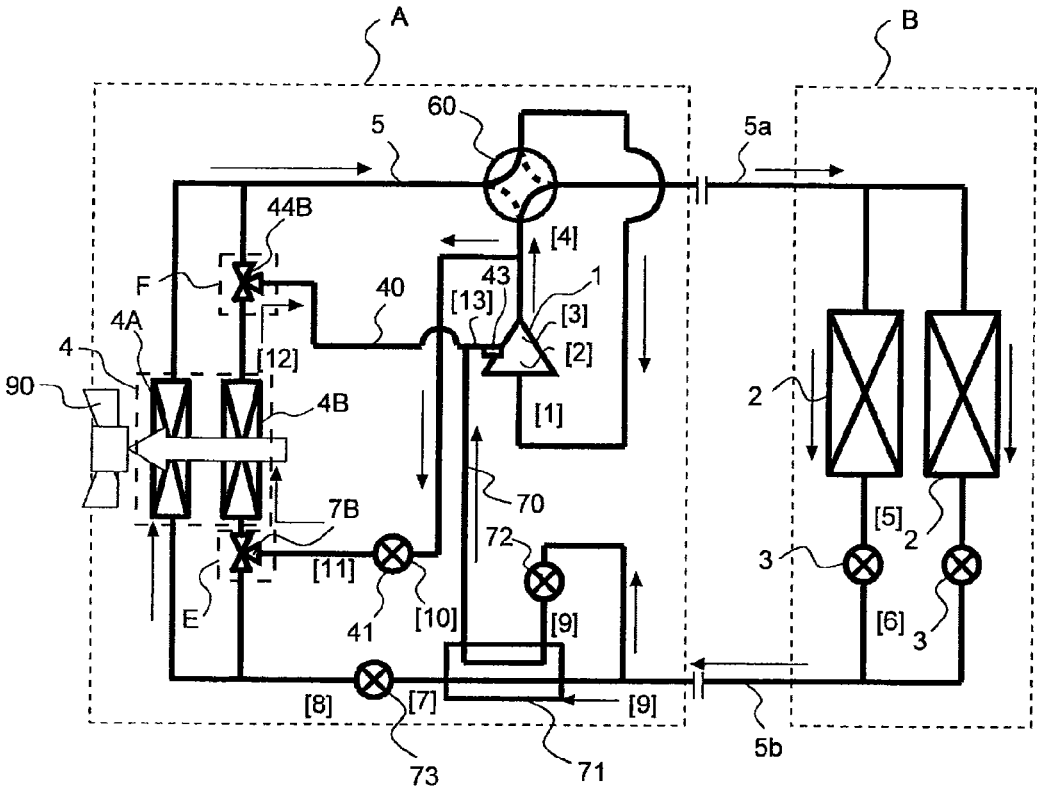
FIG. 25 illustrates the flow of refrigerant during first simultaneous heating and defrosting operation of an air-conditioning device, as an example of the heat pump according to Embodiment 5 of the present invention.
Figure 26:
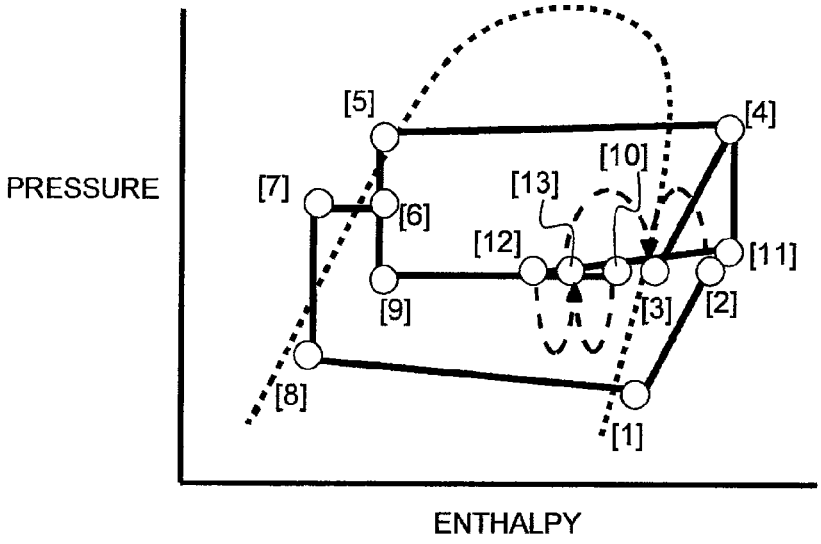
FIG. 26 illustrates the relationship between the pressure and enthalpy of refrigerant during first simultaneous heating and defrosting operation of an air-conditioning device, as an example of the heat pump according to Embodiment 5 of the present invention.

Next, a description will be given with reference to FIG. 25 that illustrates the flow of refrigerant in this device, and FIG. 26 that is a p-h diagram (diagram illustrating the relationship between the pressure and enthalpy of refrigerant). In FIG. 25, solid arrows indicate the flow of refrigerant during operation, and an open arrow indicates the flow of air. In FIG. 25, the number [i] (i=1, 2, . . . ) in parentheses indicates a pipe portion corresponding to a point i in the diagram of FIG. 26.

FIG. 25 illustrates a flow in a case where the indoor air is heated in the indoor heat exchanger 2, refrigerant is evaporated in one of the parallel heat exchangers (outdoor heat exchanger 4A in FIG. 25) constituting the outdoor heat exchanger 4 to remove heat from the outside air, and in the other parallel heat exchanger (outdoor heat exchanger 4B in FIG. 25), while frost is heated to melt the frost that has formed on the outdoor heat exchanger 4B, a part of refrigerant is injected into the refrigerant that is undergoing compression as in the first heating only operation (hereinafter referred to as first simultaneous heating and defrosting operation). Incidentally, the cooling only operation, the first heating only operation, and the second heating only operation are the same as in Embodiment 4. Also, the second simultaneous heating and defrosting operation is not performed as described above in Embodiment 5.

Hereinafter, the first simultaneous heating and defrosting operation will be described with reference to FIGS. 25 and 26.

First, a high-temperature and high-pressure gas refrigerant discharged from the compressor 1 branches off, and a part of the refrigerant passes through the four-way valve 60 and is supplied to the indoor heat exchanger 2, and the remainder flows into the first bypass pipe 6. The refrigerant that has flowed into the indoor heat exchanger 2 condenses and liquefies by exchanging heat with the indoor air, and heats the indoors. Although the change of refrigerant in the indoor heat exchanger 2 takes place under substantially constant pressure, by taking pressure loss in the indoor heat exchanger 2 into consideration, the change is represented by a line that is slightly inclined and close to a horizontal line (from Point [4] to Point [5]) in the p-h diagram. Then, this refrigerant that has turned into a liquid state flows to the first flow rate control means 3 controlled based on the amount of subcooling at the outlet of the indoor heat exchanger 2, and is reduced in pressure. The change of refrigerant in the first flow rate control means 3 takes place under constant enthalpy, and is represented by a vertical line (from Point [5] to Point [6]) in the p-h diagram. Then, the refrigerant whose pressure has been reduced branches off. A part of the refrigerant flows through the main pipe 5 as it is and flows into the heat exchanger 71, and the remainder flows into the third bypass pipe 70, is reduced in pressure in the third flow rate control means 72, and then flows into the heat exchanger 71.

The refrigerant that has flowed into the heat exchanger 71 from the main pipe 5 is cooled by exchanging heat in the heat exchanger 71 with the refrigerant from the third bypass pipe 70, and decreases in temperature. The change of refrigerant in the heat exchanger 71 takes place under substantially constant pressure, and is represented by a horizontal line (from Point [6] to Point [7]) in the p-h diagram. The refrigerant in the main circuit that is in liquid form and has decreased in temperature flows to the fourth flow rate control means 73, and is reduced in pressure into a two-phase gas-liquid state at low pressure. The change of refrigerant in the fourth flow rate control means 73 takes place under constant enthalpy, and is represented by a vertical line (from Point [7] to Point [8]) in the p-h diagram. Then, after the refrigerant whose pressure has been reduced to low pressure branches off, the refrigerant passes through the first flow switching means E, and flows into the outdoor heat exchanger 4A that is one of the outdoor heat exchangers. The refrigerant evaporates by exchanging heat with the outdoor air that has flowed through the outdoor heat exchanger 4B by the fan 90, turns into a gas state, and is sucked into the compressor 1. As for the change of refrigerant in the outdoor heat exchanger 4A, as will be described later, due to the flow of air heated by the outdoor heat exchanger 4B, the pressure becomes higher than the pressure during the first simultaneous heating and defrosting operation in Embodiment 4, and the change is represented by a line that is slightly inclined and close to a horizontal line (from Point [8] to Point [1]) in the p-h diagram.

Then, the gas refrigerant from the main circuit sucked into the compressor 1 is raised to an intermediate pressure. The change of refrigerant at this time is represented as that from Point [1] to Point [2]. Then, as will be described later in detail, the refrigerant in the state of Point [2] that has been raised to the intermediate pressure in the compressor 1 mixes with a refrigerant that has been injected from the injection port 43. The change of refrigerant by this mixing is represented as that from Point [2] to Point [3] in the p-h diagram.

The refrigerant from the main circuit sucked into the compressor 1 is compressed in the compressor 1 together with the refrigerant from the injector port 43, and changes as Point [3] to Point [4]. Then, the refrigerant in the state of Point [4] discharged from the compressor 1 flows into the indoor heat exchanger 2 again, thus completing one cycle. A heating operation is performed as refrigerant circulates in the main circuit in this way.

Meanwhile, the remainder of the high-temperature and high-pressure gas refrigerant discharged from the compressor 1 flows to the first bypass pipe 6, and in the second flow rate control means 41, the refrigerant is reduced to an intermediate pressure that is lower than the discharge pressure of the compressor 1 and higher than the suction pressure of the compressor 1. The change of refrigerant in the second flow rate control means 41 takes place under constant enthalpy, and is represented by a vertical line (from Point [4] to Point [11]) in the p-h diagram. The intermediate-pressure gas refrigerant whose pressure has been reduced passes through the first flow switching means E, and flows into the outdoor heat exchanger 4B, where the refrigerant melts the frost that has formed on the outdoor heat exchanger 4B and further, while heating the outdoor air by means of the fan 90, the refrigerant condenses and changes into a two-phase gas-liquid state at intermediate pressure. Although the change of refrigerant in the outdoor heat exchanger 4B takes place under substantially constant pressure, by taking pressure loss in the outdoor heat exchanger 4B into consideration, the change is represented by a line that is slightly inclined and close to a horizontal line (from Point [11] to Point [12]) in the p-h diagram.

The intermediate-pressure refrigerant in the two-phase gas-liquid state that has passed through the outdoor heat exchanger 4B passes through the second flow switching means F and the second bypass pipe 40, and merges with the refrigerant flowing through the third bypass pipe 70. The change of refrigerant by this merging is represented as that from Point [12] to Point [13]. Then, the merged refrigerant flows into the compressor 1 from the injection port 43. The intermediate-pressure refrigerant in the two-phase gas-liquid state injected into the compressor 1 from the injection port 43 mixes with the gas refrigerant from the main circuit (the gas refrigerant that has flowed into the compressor 1 from the outdoor heat exchanger 4A and has been compressed to an intermediate pressure within the compressor 1) in the compressor 1 and evaporates and gasifies, and decreases in temperature. The change in which the intermediate-pressure refrigerant in the two-phase gas-liquid state evaporates and gasifies through the mixing takes place under constant pressure, and is represented by a horizontal line (from Point [13] to Point [3]) in the p-h diagram.

Then, the refrigerant in the state of Point [3] is further compressed in the compressor 1 as described above, and changes to Point [4]. Incidentally, the change of the refrigerant that has flowed into the third bypass pipe 70 is the same as in the second heating only operation.

As described above, in the air-conditioning device of Embodiment 5, substantially the same effect as Embodiment 3 is obtained, and also, a heating operation can be performed while performing a defrosting operation of the outdoor heat exchanger 4B located on the upstream side of the flow of air on which snow or the like tends to deposit and frost tends to form. Further, in the first simultaneous heating and defrosting operation that defrosts the outdoor heat exchanger 4B, the air heated by the outdoor heat exchanger 4B flows through the outdoor heat exchanger 4A, and thus the pressure of refrigerant in the outdoor heat exchanger 4A can be raised. As a result, the suction pressure of the compressor 1 rises, which advantageously makes it possible to perform the first simultaneous heating and defrosting operation efficiently.

Incidentally, while the foregoing description of Embodiment 5 is directed to a configuration in which the fan 90 is provided to Embodiment 4, the configuration may be such that the fan 90 is provided to Embodiments 1 to 3, and the same operational effect can be obtained also in this case.

REFERENCE SIGNS LIST

1 compressor, 2 indoor heat exchanger, 3 first flow rate control means, 4 outdoor heat exchanger, 4A, 4B outdoor heat exchanger (parallel heat exchanger), 5 main pipe, 5*a* first pipe, 5*b* second pipe, 6 first bypass pipe, 7A, 7B three-way valve, 40 second bypass pipe, 41 second flow rate control means, 42 temperature sensor, 43 injection port, 44A, 44B three-way valve, 50 first compressor, 51 second compressor, 52 first bypass pipe, 53 second bypass pipe, 54 first temperature sensor, 55 second temperature sensor, 60 four-way valve, 70 third bypass pipe, 71 heat exchanger, 72 third flow rate control means, 73 fourth flow rate control means, 80 to 83 check valve, 90 fan, A outdoor unit, B indoor unit, E first flow switching means, F second flow switching means, G third flow switching means.

The invention claimed is:

1. A heat pump comprising:

a main circuit in which a compressor that raises a sucked low pressure refrigerant to an intermediate pressure to discharge the refrigerant as a high pressure refrigerant after further raising from the intermediate pressure to a high pressure, a condenser, a first flow rate controller, and an evaporator are sequentially connected by a main pipe, and a refrigerant circulates, the evaporator being divided into a plurality of parallel heat exchangers, the parallel heat exchangers being arranged in parallel at respective parts of a parallel circuit formed by branching off the main pipe at an arranged position of the evaporator;

a first bypass pipe whose one end is connected to the main pipe, through which the high pressure refrigerant discharged from the compressor flows to the condenser, and whose another end is branched off into parts that are connected to the main pipe on respective inlet sides of the parallel heat exchangers;

a second flow rate controller provided in the first bypass pipe;

a first flow switching device provided at a refrigerant inlet side of each of the parallel heat exchangers and configured to switch a flow of refrigerant entering each of the parallel heat exchangers from the main circuit or the first bypass pipe;

a second bypass pipe whose one end is connected to an intermediate portion of the compressor in which the refrigerant is raised to the intermediate pressure, and whose another end is branched off into parts that are connected to the main pipe on respective outlet sides of the parallel heat exchangers; and a second flow switching device provided at a refrigerant outlet side of each of the parallel heat exchangers and configured to switch a flow of refrigerant discharging from each of the parallel heat exchangers to the main circuit or the second bypass pipe, wherein during a defrosting operation that removes frost on the parallel heat exchangers, a part of the high pressure refrigerant discharged from the compressor is passed through the first bypass pipe, and reduced in pressure to be lower than a discharge pressure and to be higher than a pressure at an injection in the second flow rate controller, the refrigerant that has been decreased in temperature and reduced in pressure is supplied to a parallel heat exchanger that is defrosted, and the refrigerant that has been condensed by the parallel heat exchanger to be in a liquid state or a two-phase gas-liquid state is then passed through the second bypass pipe and is merged at a point where the refrigerant in the compressor is raised to the intermediate pressure.

2. The heat pump of claim 1, wherein:

the second flow rate controller controls a flow rate of the refrigerant that flows from the main pipe into the first bypass pipe; and including a temperature sensor measuring a discharge temperature of the refrigerant from the compressor, wherein the second flow rate controller controls the flow rate of the refrigerant in accordance with the discharge temperature measured by the temperature sensor.

3. The heat pump of claim 2, wherein the compressor includes an injection port at an intermediate pressure portion where the refrigerant is raised up to the intermediate pressure, and the refrigerant that is passed through the second bypass pipe is injected from the injection port.

4. The heat pump of claim 1, wherein:

the compressor is configured such that a first compressor that sucks the low pressure refrigerant and raise to the intermediate pressure to discharge the same and a second compressor that sucks an intermediate-pressure refrigerant discharged by the first compressor to discharge the same as a high pressure refrigerant are connected by the main pipe, and the refrigerant is passed through the second bypass pipe and merged with the main pipe between the first compressor and the second compressor.

5. The heat pump of claim 4, wherein:

the second flow rate controller controls a flow rate of the refrigerant that flows from the main pipe into the first bypass pipe; and including a temperature sensor measuring a discharge temperature of the refrigerant from the second compressor, wherein the second flow rate controller controls the flow rate of the refrigerant in accordance with the discharge temperature measured by the temperature sensor.

6. The heat pump of claim 4, wherein:

the second flow rate controller controls a flow rate of the refrigerant that flows from the main pipe into the first bypass pipe; and including a temperature sensor measuring a suction temperature of the refrigerant from the second compressor, wherein the second flow rate controller controls the flow rate of the refrigerant in accordance with the suction temperature measured by the temperature sensor.

7. The heat pump of claim 1, further comprising:

a third bypass pipe that branches a part of the refrigerant flowing from the first flow rate controller toward the evaporator to merge the part of refrigerant to the second bypass pipe;

a heat exchanger that exchanges heat of other refrigerant flowing from the first flow rate controller toward the evaporator with the refrigerant that has flowed from the third bypass pipe toward a third flow rate controller and has been reduced in pressure to cool the other refrigerant; and a fourth flow rate controller that reduces a pressure of the refrigerant that has been cooled in the heat exchanger and flows toward the evaporator.

8. The heat pump of claim 1, further comprising:

a four-way valve that switches a circulation direction of the refrigerant in the main circuit, wherein a cooling operation or a heating operation is performed by switching the four-way valve.

9. The heat pump of claim 8, wherein the plurality of parallel heat exchangers are combined in a bridged configuration together with four check valves so that a flow direction of the refrigerant flowing through the plurality of parallel heat exchangers is one direction irrespective of an operation mode, and flow switching means provided on each of inlet side and outlet side of each of the parallel heat exchangers is configured as a two-way switching valve that allows the refrigerant to flow in only one direction.

10. The heat pump of claim 1, further comprising:

a fan that flows air that is made to exchange heat with the refrigerant from one side of the parallel heat exchangers to another side sequentially, wherein part of the parallel heat exchangers located on an upstream side of the air from the fan is defrosted.

11. The heat pump of claim 1, wherein the compressor includes an injection port at an intermediate pressure portion where the refrigerant is raised up to the intermediate pressure, and the refrigerant that is passed through the second bypass pipe is injected from the injection port.

* * * * *